US012096808B2

(12) United States Patent
Samuelson

(10) Patent No.: US 12,096,808 B2
(45) **Date of Patent: *Sep. 24, 2024**

(54) NURSING COVER WITH INTEGRATED COOLING FAN

(71) Applicant: Jacqueline Samuelson, Mesa, AZ (US)

(72) Inventor: Jacqueline Samuelson, Mesa, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/519,293

(22) Filed: Nov. 27, 2023

(65) Prior Publication Data

US 2024/0081433 A1 Mar. 14, 2024

Related U.S. Application Data

(63) Continuation-in-part of application No. 18/198,455, filed on May 17, 2023, now Pat. No. 11,849,776.

(Continued)

(51) Int. Cl.

| | |
|---|---|
| ***A41D 1/215*** | (2018.01) |
| ***F04D 25/06*** | (2006.01) |
| ***F04D 25/08*** | (2006.01) |

(52) U.S. Cl.

CPC ..... *A41D 1/215* (2018.01); *F04D 25/0673* (2013.01); *F04D 25/08* (2013.01)

(58) Field of Classification Search

CPC ..... A41D 1/215; A41C 3/04

See application file for complete search history.

(56) References Cited

U.S. PATENT DOCUMENTS 5,034,999 A * 7/1991 Lubbers ..... A41D 1/215 2/104

5,544,364 A * 8/1996 Weber ..... A41D 1/215 2/48

(Continued)

FOREIGN PATENT DOCUMENTS

JP 2020037935 A 3/2020

OTHER PUBLICATIONS

"Neck Fan, Portable Bladeless Personal Fans Rechargeable Battery, Small Hands Free Hanging Cooling USB Fan, 3 speeds wind, Free Adjustment , Wearable for Weeding Camping Sports Outdoor," amazon.com. https://www.amazon.com/dp/B09YBZ88SB/ref=twister_B0928XPW4W?_encoding=UTF8&th=1 [Date accessed: Dec. 27, 2022].

(Continued)

*Primary Examiner* — Gloria M Hale

(74) *Attorney, Agent, or Firm* — Bold IP PLLC

(57) ABSTRACT

A nursing cover having an integrated cooling neck fan in which the integrated cooling neck fan is bladeless, removable, and bendable over a range of angles. The inside top area of the nursing cover includes at least one hook and loop strip that extends in a horizontal direction or another type of fastener. Additional hook and loop strips are on a top surface of the cooling neck fan such that the cooling neck fan is removably attachable to the inside top area of the nursing cover. A user grabs the two ends of the neck fan to bring the nursing cover closer or further away and adjust distance of air vents on the neck fan from a nursing child covered by the nursing cover while held by the mother. The nursing cover includes a neck strap and a long fabric portion that thoroughly covers the mother and nursing child. The nursing cover can be a partial nursing cover or a 360-degree nursing cover.

19 Claims, 15 Drawing Sheets

Related U.S. Application Data

(60) Provisional application No. 63/397,365, filed on Aug. 11, 2022.

(56) References Cited

U.S. PATENT DOCUMENTS

| | | | | |
|---|---|---|---|---|
| 5,725,356 | A | 3/1998 | Carter | |
| 7,114,191 | B1 * | 10/2006 | Butler-Penenberg | A41D 1/215 2/104 |
| 8,671,465 | B2 * | 3/2014 | Armstrong | A41D 1/215 2/48 |
| 8,990,968 | B2 * | 3/2015 | Garegnani | A41D 1/215 2/104 |
| 9,380,815 | B2 * | 7/2016 | Toro-Gerstein | A41D 1/215 |
| 9,687,084 | B2 | 6/2017 | Sclare et al. | |
| 9,968,148 | B2 * | 5/2018 | Gibbons | A41D 1/215 |
| 10,010,119 | B2 * | 7/2018 | Butler | A41D 1/215 |
| 10,264,832 | B2 * | 4/2019 | Gibbons | A41D 23/00 |
| 11,849,776 | B1 * | 12/2023 | Samuelson | A41D 1/215 |

OTHER PUBLICATIONS

"Baby Breeze Nursing Cover with Fan," ebay.com. https://www.ebay.com/itm/111808081821?fbclid=IWAR2drTJU6sBsfFUqi8oQfvkVcbXYMqifwnWUzk6JEOywdfey8x-tAklcwA0&ul_noapp=true [Date accessed: Dec. 27, 2022].

* cited by examiner

NURSING COVER WITH INTEGRATED COOLING FAN

CROSS-REFERENCE TO RELATED APPLICATIONS

This application is a continuation-in-part application of non-provisional application Ser. No. 18/198,455, and which was filed on May 17, 2023, which is also known as U.S. Pat. No. 11,849,776 and which issued on Dec. 26, 2023, which claims priority to U.S. Provisional Patent Application No. 63/397,365 filed on Aug. 11, 2022, which is incorporated by reference in its entirety.

FIELD OF THE DISCLOSURE

The present invention relates to various embodiments for a nursing cover having an integrated fan unit for cooling a nursing baby that has improved safety and use features.

BACKGROUND

Nursing mothers have to take into consideration that, in warm climates, their babies will be uncomfortably hot if the heads and faces of the babies as well as the chest of the nursing mother is covered. However, nursing mothers also desire a means to shield their chests while nursing their children without overexposure of their chest area. Existing nursing covers do not offer a cooling system integrated into a nursing cover that may prevent a nursing baby from overheating and still provide privacy and coverage of the chest and breasts of a nursing mother.

A significant disadvantage for mothers who breast feed their children and use nursing covers is that the nursing cover prevents the infant from receiving proper airflow. Nursing covers cover a great deal of the body of the infant and side of the infant's face, which does not allow the infant to receive a proper amount of airflow and to cool the sides of the infant's face and the infant's body. Conventional nursing covers trap heat inside which makes the nursing infant excessively hot and also can make the mother's midsection hotter, which also increases the amount of heat within the nursing cover around the infant. This is of significant concern because infants are vulnerable to heat-stroke and overheating. This may also be particularly true if the infant is outdoors, the temperature is high, and the infant is wearing layers of clothing. Notably, infants and nursing babies are not able to regulate their body temperatures and are prone to overheating in particular when placed under a large piece of cloth and placed against another warm body. Most nursing covers do not have any ability to prop or adjust the placement of the cloth away from the nursing infant's face or neck. Further, nursing covers do not include cooling devices that are adjustable in their placement on the neck-line.

Accordingly, there is still a need for a nursing cover having an integrated cooling system that is safe and effective for use while nursing a baby and that is bladeless.

SUMMARY

One or more embodiments are provided for a system for nursing a child comprising a nursing cover with a built in or removably attachable cooling device. The nursing cover includes a neck strap and an elongated cover piece. The neck strap is attached to the elongated cover piece at various attachment points on a top edge of the elongated cover piece.

The elongated cover piece further comprises a bendable structural element contained inside and integrated into a top area of the elongated cover piece, wherein the bendable structural element is proximate to the top edge of the elongated cover piece and causes a neckline of the elongated cover piece to be adjustable. Additionally, one or more horizontally extending hook and loop fastening strips are integrated into or attached to an interior surface of the nursing cover near the top edge of the elongated cover piece. The built in or removably attachable cooling device is in the form of a neck fan comprising a flexible, bendable single body having a curved central top piece that is connected to a left side member and a right side member, wherein the single body is capable of bending to form a general U-shape or being straightened over a range of angles including to approximately 180 degrees. The neck fan further includes several air vents/air holes distributed along the left side member and the right side member of the neck fan through which air exits.

One or more hook and loop fastening strips are attached to a top surface of the single body of the neck fan, wherein the one or more hook and loop fastening strips attached to the top surface of the single body of the neck fan are adapted to removably fasten to the one or more horizontally extending hook and loop fastening strips attached to the interior surface of the nursing cover near the top edge of the elongated cover piece; wherein the neck fan removably attaches to the nursing cover.

In another aspect, a first strap and a second strap are attached to the interior surface of the nursing cover beneath the one or more horizontally extending hook and loop fastening strips. In another aspect, the first securing strap and the second securing strap each include a snap fastener. In another aspect, the neck fan is bladeless and has no visible fan blade. Further, the neck fan is rechargeable and portable. Further, the neck strap and the elongated cover piece of the nursing cover may be made of fabric including muslin. In one aspect, the bendable structural element is a bendable metal wire, a plastic element, or a combination of combination of metal and plastic material formed into the bendable structural element. Alternatively, the bendable structural element can be made of wood or any other material as needed.

The present description further includes a non-limiting embodiment for a method of using a nursing cover with an integrated cooling device. The method includes providing a nursing cover, attaching the neck fan to the nursing cover by connecting the one or more hook and loop fastening strips on the top surface of the single body of the neck fan to the one or more horizontally extending hook and loop fastening strips attached to the interior surface of the nursing cover near the top edge of the elongated cover piece, and adjusting a shape of a neckline of the nursing cover by pulling forward or pushing back on the first air discharge area and the second air discharge area of the neck fan while the neck fan is attached to the interior surface of the nursing cover near the top edge of the elongated cover piece of the nursing cover. The method further includes powering on the neck fan to provide air to a nursing child covered by the nursing cover and powering off the neck fan upon completing of nursing. In the case where the neck fan is not built into the nursing cover, the neck fan may be removed for recharging. The method may further include removing the neck fan by pulling the neck fan off of the one or more horizontally extending hook and loop fastening strips attached to the interior surface of the nursing cover near the top edge of the elongated cover piece.

Advantageously, the neck fan can be oriented to point downwards when attached to the interior of the nursing cover such that the cooling air vents are oriented towards the child's face while nursing to cool the child or the neck can be oriented to point upwards when attached to the interior of the nursing cover such that the cooling air vents are oriented towards the user's face which may be useful for example when the user or mother is pumping and would like the neck fan to cool the mother's face and also to have coverage and privacy of her chest while pumping.

The method may further comprise securing the neck fan in place with one or more integrated straps and fasteners to the interior surface of the nursing cover and securing a neck strap using an attached fastener to tighten or loosen the neck strap.

The present description further includes one or more non-limiting embodiments for a nursing cover that is a 360 degree nursing cover, wherein the nursing cover comprises material that covers a front side, left side, right side, and back of a wearer. In a non-limiting embodiment, there may also be described nursing covers that are not a 360-degree nursing cover, which may have an open back and/or side area that leaves a back of a wearer exposed when worn. In a non-limiting embodiment, the neck fan may be built into a nursing cover (e.g., less than or equal to 360-degree nursing cover), such that the neck fan is attached by sewing over areas of the flexible, bendable body of the neck fan to hold the neck fan in place near the top edge of the elongated cover piece of the nursing cover.

Other aspects and advantages of the invention will be apparent from the following description and the appended claims.

BRIEF DESCRIPTION OF THE DRAWINGS

Embodiments of the present disclosure are described in detail below with reference to the following drawings. These and other features, aspects, and advantages of the present disclosure will become better understood with regard to the following description, appended claims, and accompanying drawings. The drawings described herein are for illustrative purposes only of selected embodiments and not all possible implementations and are not intended to limit the scope of the present disclosure.

DETAILED DESCRIPTION

The present disclosure is generally drawn to a nursing cover with a neck strap sewn or otherwise connected to an elongated large piece of cloth that is adapted to serve as a cover that covers a significant portion of a mother's chest, midsection, and sides of the body to cover a baby or infant nursing beneath the nursing cover. Further, the nursing cover includes one or more straps of VELCRO (a.k.a. hook and loop fasteners) positioned horizontally near a top edge of the inside surface of the nursing cover. A neck fan that is bendable and adjustable in shape has additional pieces or straps of VELCRO positioned on a top surface of the neck fan that are configured to mate with the one or more straps of VELCRO attached to the inside surface of the nursing cover. The neck fan can be pulled to narrow the neckline of the connected nursing cover or can be extended to widen the neckline of the connected nursing cover. The act of pulling forward or pushing back on the sides of the removably attached neck fan causes the nursing cover to either have a wider or narrower neckline to suit the preferences of the nursing mother. Further details will be provided with respect to the accompanying Figures.

Figure 1:
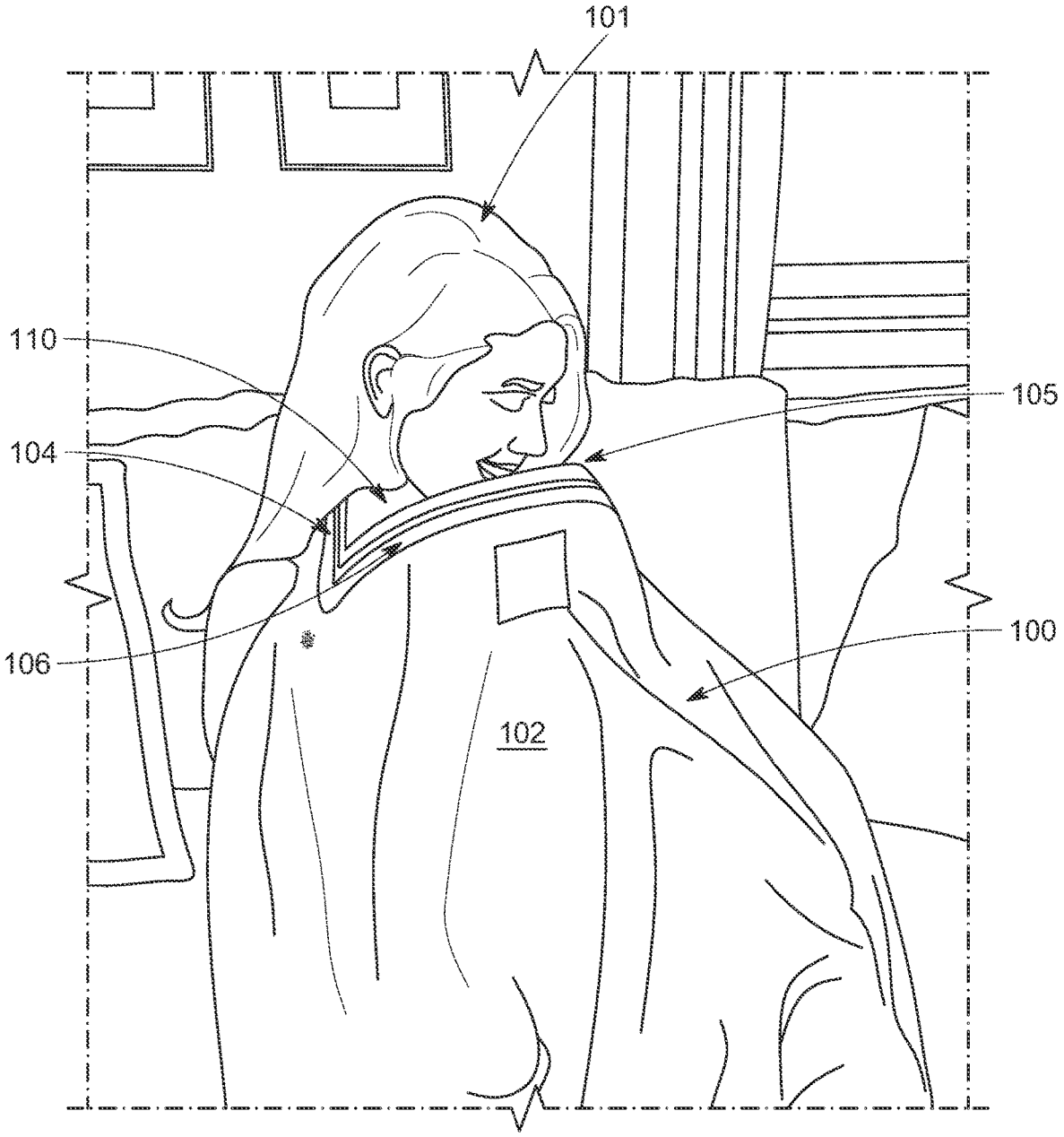
FIG. 1 is a pictorial illustration of a user wearing an exemplary nursing cover with an integrated cooling device.
Figure 4A:
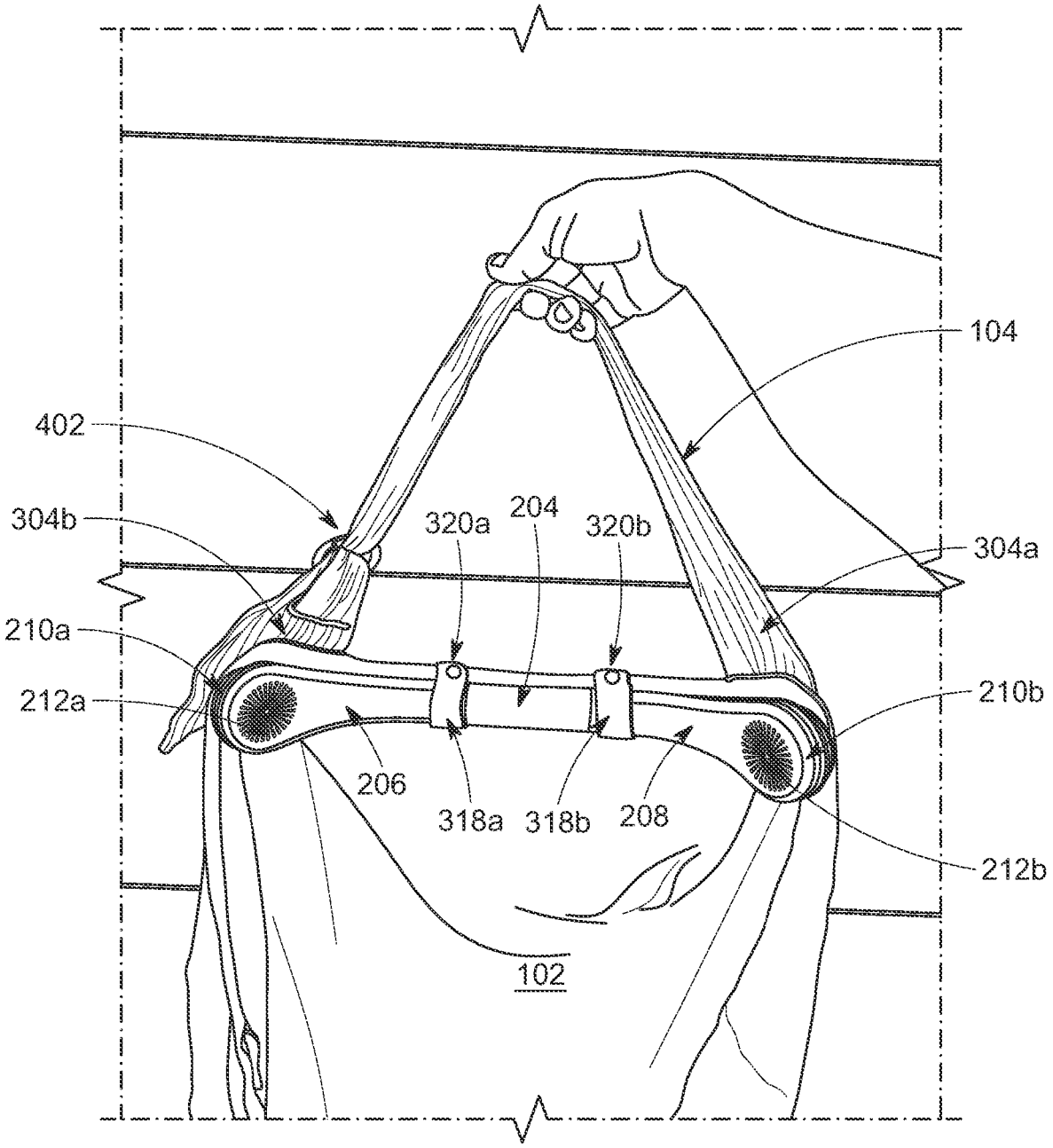
FIG. 4A is a pictorial illustration of an interior view of the attachable cooling device attached to an inside surface of a nursing cover.

FIG. 1 depicts a user wearing a nursing cover 100 that is adapted to include a cooling device (e.g., cooling device 202). As shown in FIG. 1, the user 101 is wearing a nursing cover 100 that includes a neck strap 104 attached to an elongated cover piece 102 to make up or form the nursing cover 100. The neck strap 104 encircles the neck of the user 101 and may be tied with a knot or using a fastener 402, which is shown in FIG. 4A. The top edge 110 of the nursing cover 100 and the neck line 105 advantageously are propped up away from the neck and chest of the nursing mother 101 as shown in FIG. 1. This may be due in part to the presence of a bendable shaping element 106 integrated into the upper area of the elongated cover piece 102 of the nursing cover 100.

Figure 2A:
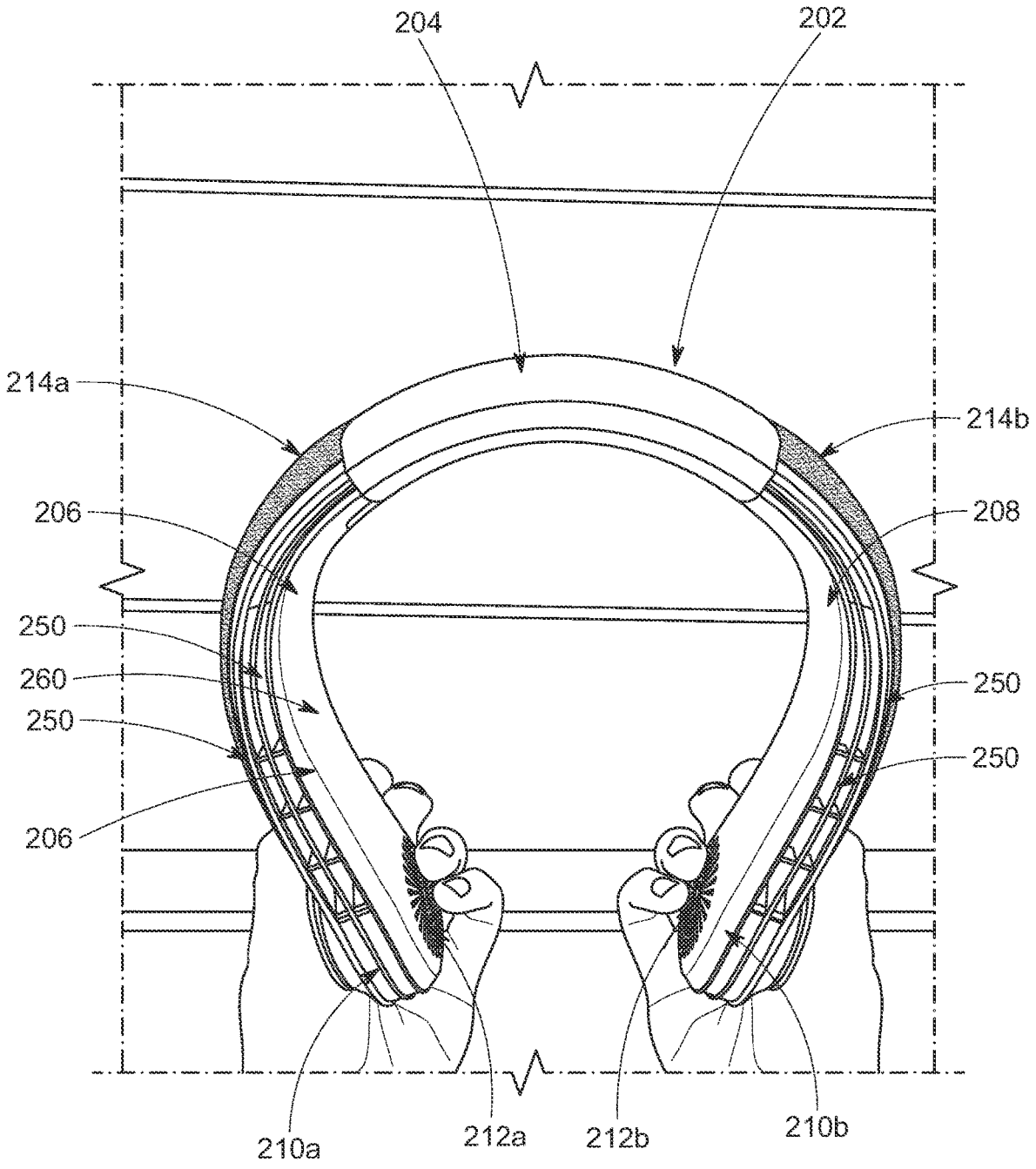
FIG. 2A is a pictorial illustration of a front side/cooing side of an exemplary attachable cooling device.
Figure 2B:
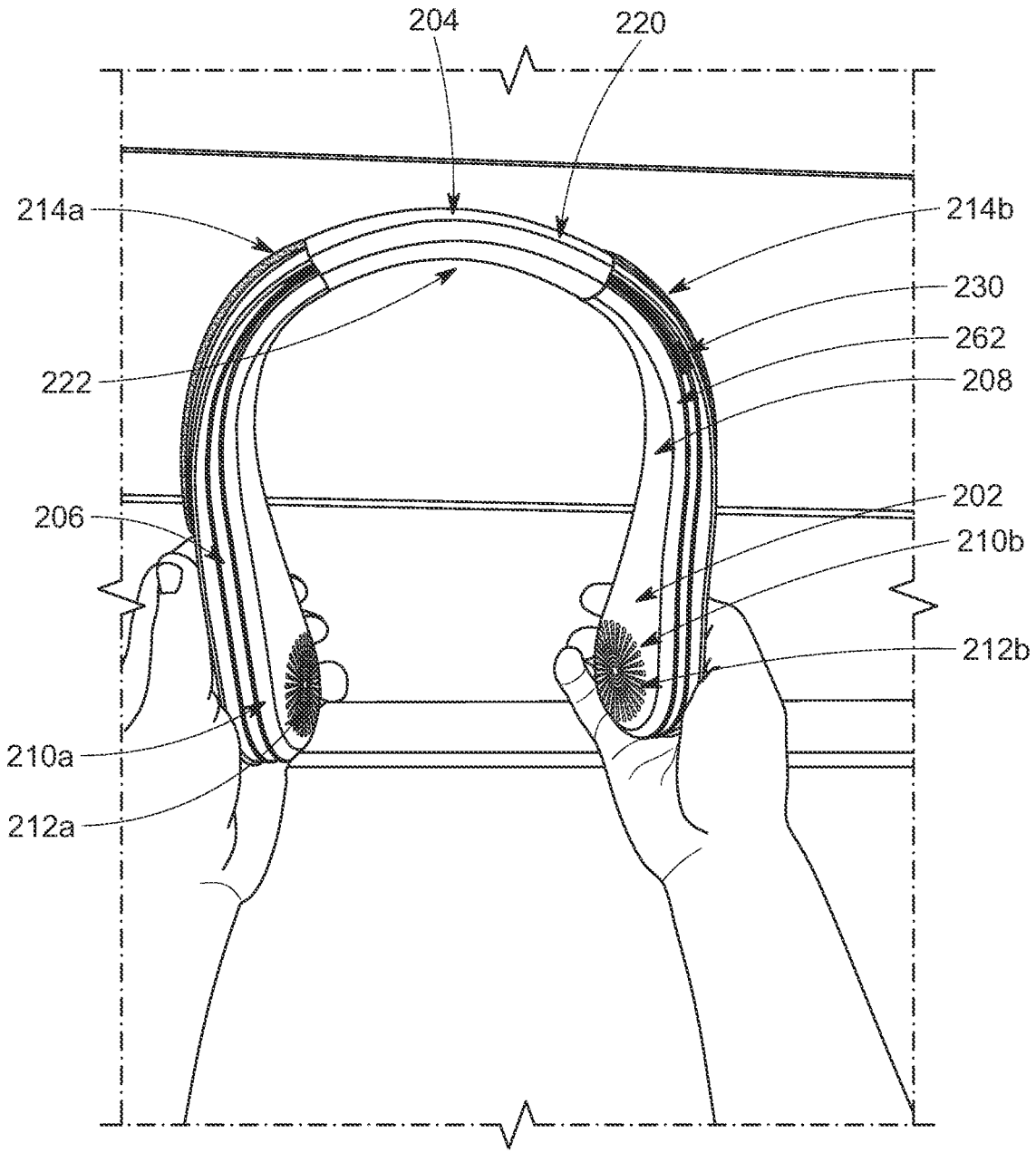
FIG. 2B is a pictorial illustration of a rear side/non-cooling side of the exemplary attachable cooling device.
Figure 2C:
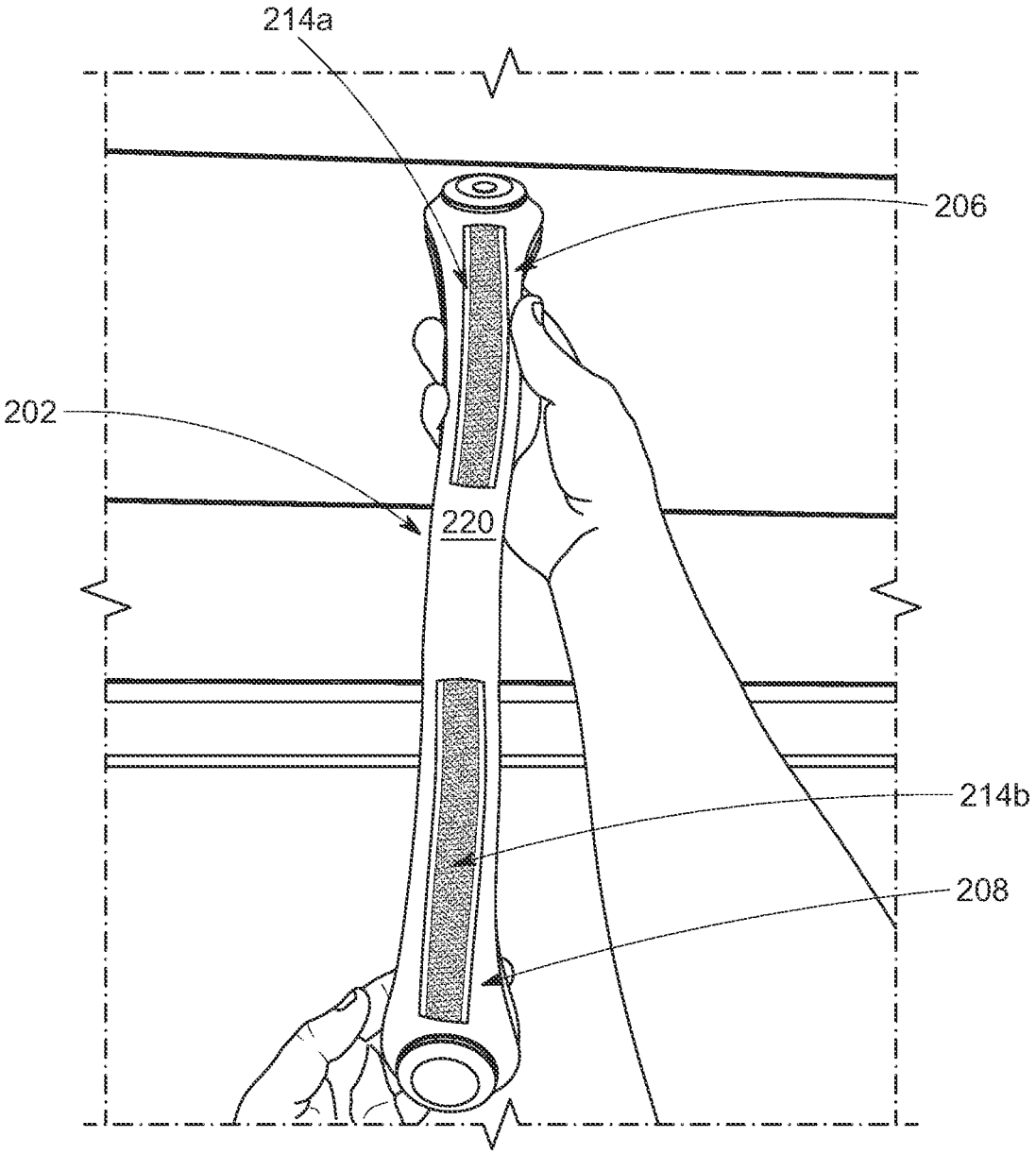
FIG. 2C is a pictorial illustration of the exemplary attachable cooling device shown in FIG. 2A in expanded form.

FIG. 2A, FIG. 2B, and FIG. 2C display an exemplary cooling neck fan that is useable to cool a nursing child while the user 101 is wearing the nursing cover 100. FIG. 2A shows the front side 260 of the neck fan 202, while FIG. 2B shows the reverse side of the neck fan 202. In a non-limiting embodiment, the cooling neck fan 202 comprises a single body that is capable of bending into a general U-shape as shown in FIG. 2A and can bend over a range of angles including up to at least or approximately 180 degrees as shown in FIG. 2B. The neck fan 202 has integrated machinery and a rechargeable battery that provides cooling air through the air vent holes or outlets 250 that are disposed on and scattered around the left side member 206 and the right side member 208 of the neck fan 202. In a non-limiting embodiment, as shown in FIG. 2A, there may be at least fourteen to sixteen separate air vents/holes/outlets 250 for air to flow out of the neck fan 202 (and onto the baby or mother depending on how the neck fan 20 is directed or aimed). In a non-limiting embodiment, air flows out of the neck fan 202 that is not necessarily cold but that is still cooling due to the presence of the fan air emitted from the air outlets 250. Further, the user can adjust the neck fan 202 using one or more integrated buttons/selectors to select different wind speeds/flowrates for the emitted air to provide a greater amount of air to flow on the nursing baby or nursing mother (depending on direction of orientation of air outlets 250). In other non-limiting embodiments, the neck fan 202 may emit cooled air and the neck fan 202 may integrate a mechanism to emit cooled air.

Ambient air enters into the air intake holes 212*a* shown on first fan inlet 210*a* and also through the air intake holes 212*b* shown on first fan inlet 210. The neck fan 202 is a type of neck fan that may be purchased as a whole single unit and is portable and is rechargeable. Further, neck fan 202 does not include exposed rotatable fans as typically seen with many hand held fans in which the turning blades could be accessed by one's fingers from the outside of the neck fan 202. "Bladeless" may further mean that there are no rotating blades that can be accessed by a user from the exterior of the neck fan 202 because any "blades" or rotating elements that are used to produce the air of the neck fan 202 are surrounded by the protective plastic or other protective material of the neck fan 202. In some cases, any rotating elements used to produce cooling air may not be visible at all from the exterior of the neck fan 202. Even if any interior components used to produce air from the neck fan 202 from the air vents 250 are visible, the rotating elements are designed in a way to ensure fingers cannot access the rotating elements nor are the rotating elements sharp enough to injure any user.

The neck fan 202 is designed such that any rotational blades are contained within the neck fan 202 and covered by the various sides (e.g., 204, 206, or 208) of the neck fan 202 and cannot be touched or accessed by a user or other party when these sides 204, 206, or 208 of the neck fan 202 are in place. This feature advantageously ensures that the neck fan 202 is safe for a mother 101 to include and attach to or that can be built into the nursing cover 100 as a nursing child will not be endangered by exposed, rotating fan blades. Further, the nursing mother's safety is further protected by the bladeless neck fan 202 from her hair becoming entangled or caught in any fan blades.

Notably, the neck fan 202 is an example of a wearable neck fan that people can place on their neck and wear on their neck to enjoy consistent air flow. A non-limiting example of such a neck fan may be obtained from DARTWOOD. Accordingly, such neck fans 202 do exist currently and are typically worn around the neck of the wearer to provide air. However, currently such neck fans 202 are not integrated into nursing covers 100 prior to the present description in the manner described herein.

In a non-limiting embodiment, the neck fan 202 includes a low noise level and adjustable settings to adjust the amount of air provide from the neck fan. In a non-limiting embodiment, the neck fan 202 includes at least three different settings for adjusting the airflow speed provided from the neck fan 202. The user 101 is able to toggle through a power button or other selection button to select the one or more different airflow speeds to increase or decrease the speed of the airflow as directed on either the mother (e.g., the user 101) or the nursing child depending on how the neck fan 202 is directed while attached to the nursing cover 102. The neck fan 202 further includes an integrated rechargeable battery pack. FIG. 2B includes reference number 230 pointing to an exemplary port that may be used to recharge the neck fan 202.

Advantageously, the bladeless neck fan 202 does not have any exposed rotating blades as are typical of most portable hand held fans so the user 101 does not have to be concerned about any danger from any rotating blades near the nursing mother's 101 infant baby who is hidden beneath the nursing cover 100.

The neck fan 202 is able to deliver consistent air flow from various air vents or outlets 250 integrated into the left side member 206 and the right side member 208 of the neck fan 202 at various selectable speeds of airflow according to one or more non-limiting embodiments. In a non-limiting embodiment, the neck fan 202 provides air flow from one or more air vents/openings 250 arranged side by side and over each other on the left side member 206 and on the right side member 208 of the body of the neck fan 202.

Ambient air enters into the first air inlet 210*a* and through the first air inlet holes 212*a* located near the bottom area of the left side member 206 of the neck fan 202. Further, in a non-limiting embodiment, the neck fan 202 may further have ambient hair flow into the second first air inlet 210*b* and its respective air inlet holes 210*b* located near the bottom area of the right side member 208 of the neck fan 202. The air intake holes vents 212*a*, 212*b* on the first fan inlet 210*a* and on the second fan inlet 210*b* are shown as small holes arranged in concentric circles that recede towards a center of the first and second fan inlets 210*a*, 210*b*. However, this may be only one design for the arrangement of the air inlet holes 212*a*, 212*b*. In other non-limiting embodiments, there may be a greater or lesser number of air inlet holes 212*a*, 212*b* than that shown in FIG. 2A. There may be larger air inlet holes 212*a*, 212*b* than those shown in FIG. 2A. The same is true for the air dispensed from the air vents or holes or openings 250 arranged on the left side member 206 and the right side member 208 of the body of the neck fan. The air vents 250 may be greater or lesser in number than that show in the exemplary images shown in FIGS. 2-4E. Further the air vents 250 may be larger or smaller in size and positioned in addition on the front or back side of the neck fan 202.

As shown in FIG. 2C, the neck fan 202 can be bent and its shape adjusted over a range of degrees and angles including to or approximately to 180 degrees in a generally straight line as shown in FIG. 2C. This allows the user to be able to flexibly move and adjust the neck fan 202 over a range of positions and angles from the general U-shape shown in FIG. 2A and in FIG. 2B to the flatter, straighter position as shown in FIG. 2C.

As shown in FIG. 2A and in FIG. 2B, in a non-limiting embodiment, the present description allows for one or more pieces of hook and loop fasteners (e.g., VELCRO) to be adhesively stuck to the top side 220 of the neck fan 202. VELCRO is the brand name of a hook and loop fastener and one example of a type of hook and loop fastener that may be selected to act as a fastener and connected to one or more sides on the top side 220 or underside 222 (e.g., as shown in FIG. 2A) of the neck fan 202. It is noted that in other non-limiting embodiments, other types of fasteners may be used alternative to the VELCRO or hook and loop fastener strips 214*a*, 214*b*, such as snaps or buttons that can connect to corresponding mates or pairs to the snaps or buttons.

In a non-limiting embodiment, one or more pieces or strips of hook and loop fasteners 214*a*, 214*b*, as shown in FIGS. 2A-2B, are attached using the adhesives integrated on the underside of the strips of the hook and loop fasteners 214*a*, 214*b* to the top side 220 of the neck fan 202. In addition to the adhesives integrated on the underside of the strips of the hook and loop fasteners 214*a*, 214*b*, other attachment mechanisms and means may be used to further ensure the attachment of the hook and loop fasteners 214*a*, 214*b* onto a top side 220 of the neck fan 202. Such attachment mechanisms include using staples, fasteners, additional adhesive separate from the VELCRO adhesive, or other attachment mechanism to ensure the hook and loop fastener strips 214*a*, 214*b* are secured in place. In the illustration shown in FIG. 2C, there is a first strip of a hook and loop fastener 214*a* attached to the left side member 206 of the neck fan 202 and a second strip of a hook and loop fastener 214*b* on the right side member 208 of the neck fan 202. While in the illustration shown in FIG. 2C there is not a strip of a hook and loop fastener attached to the center area 204 of the neck fan 202, in other non-limiting embodiments, this center area 202 may also include a strip of a hook and loop fastener such as hook and loop fasteners 214*a*, 214*b*.

Figure 3A:
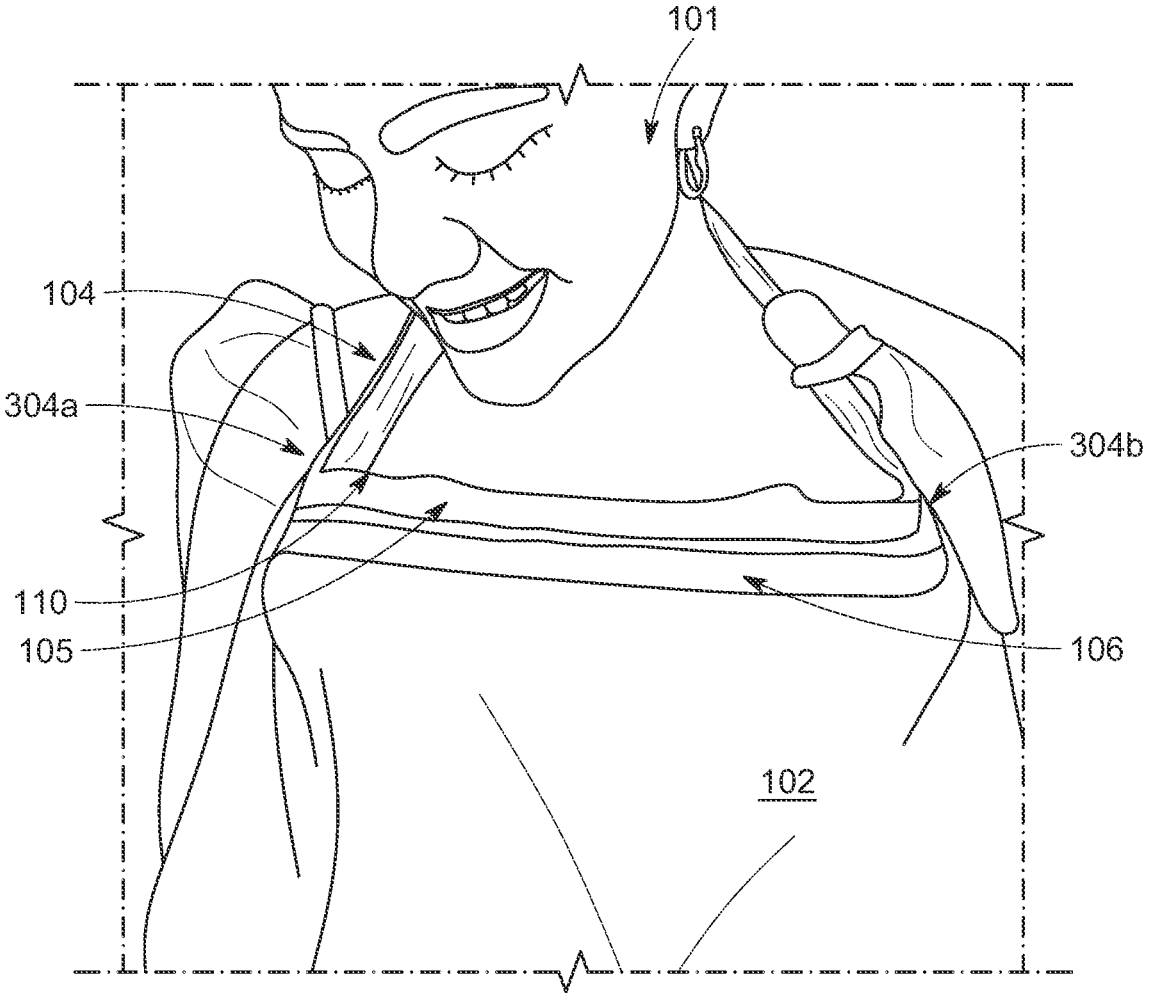
FIG. 3A is a pictorial illustration of the user wearing the exemplary nursing cover.

FIG. 3A displays another view of the nursing cover 100 as worn by the user 101, i.e., the nursing mother. The nursing cover 100 as shown in FIG. 3A includes a neck strap 104 that is connected to the elongated cover piece 102. The neck strap 104 may be attached by sewing in one or more non-limiting embodiments at first attachment point 304*a* and at second attachment point 304*b* such that each end of the neck strap 104 is attached to a top edge 110 of the neck line 105 of the nursing cover 100. FIG. 3A shows a front view or exterior view of the nursing cover 100. While FIGS. 3B-4D display a reverse or interior view of the nursing cover 100, and in some cases, with the neck fan 202 attached to the nursing cover 100 as further discussed below.

The neck strap 104 may include a tie or a knot to tie the neck strap 104 around the neck of the user 101 as shown in FIG. 1 and in FIG. 3A. On an underside or the top side in one or more non-limiting embodiments, may be a neck strap fastener 402, as shown in FIG. 4A that allows the user to secure and to adjust the length and/or tightness of the neck strap 104 to suit the preferences of the user 101. In a non-limiting embodiment, the neck strap 104 is made of fabric. Preferably, the neck strap 104 is made from a non-irritating, cooling fabric that may include muslin, cotton, or any other type of material known in the art without limitation thereto.

Figure 4B:
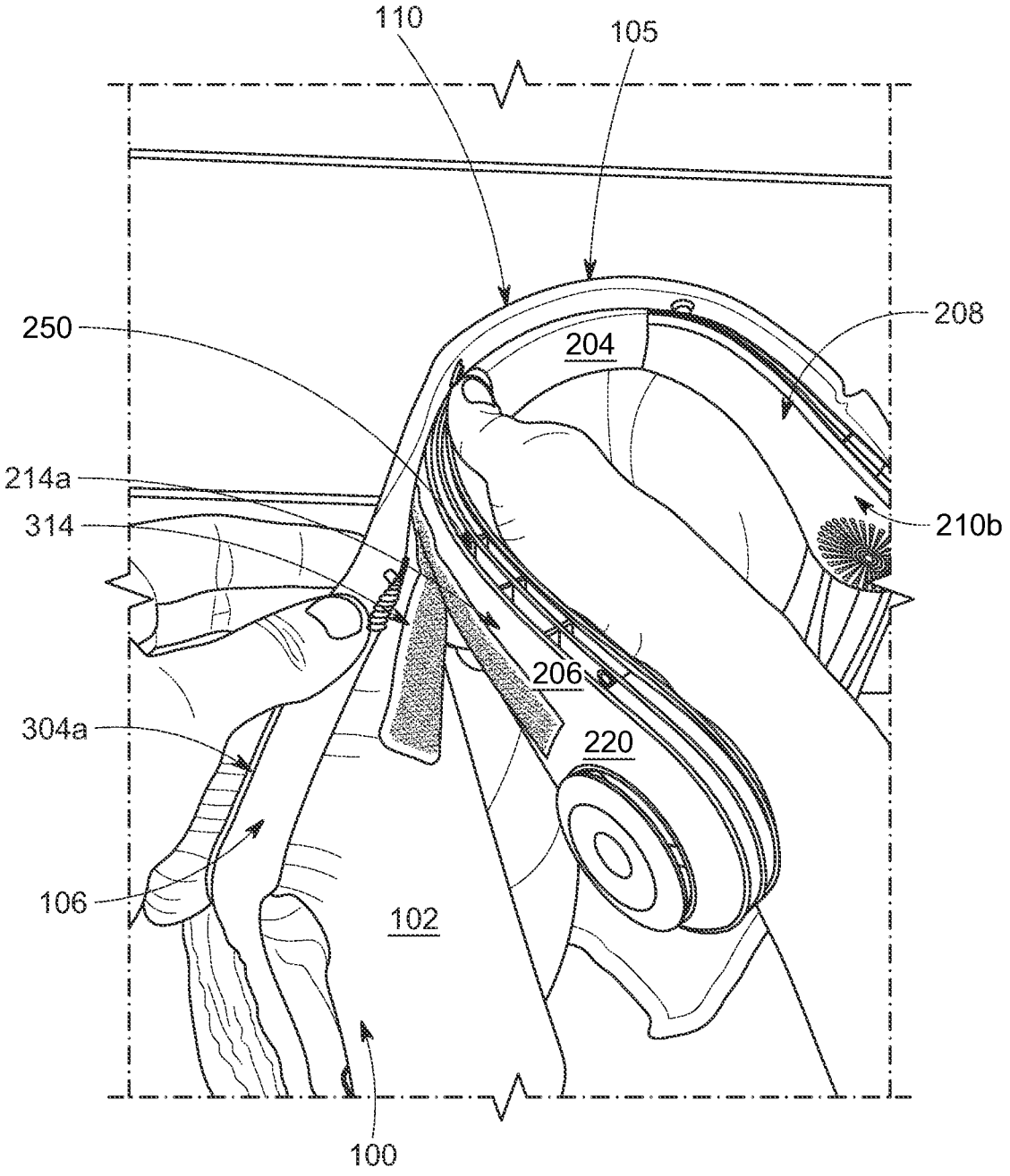
FIG. 4B is a pictorial illustration of the exemplary attachable cooling device being attached to the inside surface of a nursing cover.

In a non-limiting embodiment, the elongated cover piece 102 of the nursing cover 100 is a large, generally rectangular piece of fabric. The elongated cover piece 102 preferably covers a portion of the chest 450 (e.g., as shown in FIG. 4E) and midsection, including the sides of the midsection and front of the midsection of a wearer or user 101. The elongated cover piece 102 may be long enough to stretch down to a user's knees in some cases. The elongated cover piece 102 may be made of fabric. Preferably, the fabric used to make the elongated cover piece 102 is cooling and non-irritating to the user/wearer 101. Such fabrics may include, but are not limited to, muslin, cotton, or any other material or combination of materials.

As shown in FIG. 1 and in FIG. 3A, visible from the front side of the nursing cover 100 may be the bendable shaping element 106 that is integrated into the material of the nursing cover 100. The bendable shaping element 106 is not attached to the outside or the exterior of the nursing cover. Rather, the bendable shaping element 106 is sewn into and integrated into the neckline 105 of the elongated cover piece 102. The bendable shaping element 106 is covered entirely by the fabric of the elongated cover piece 102 on all sides and is not accessible to the user 101 or another party from the front or back or any side of the nursing cover 100 when the bendable shaping element 106 is positioned in place and the fabric of the elongated cover piece 102 is sewn to cover the bendable shaping element 106. The bendable shaping element 106 may be made of bendable wire, plastic, or a combination thereof or a combination of any other materials without limitation thereto. The bendable shaping element 106 may be thin or thick. As shown in FIG. 1 and in FIG. 3A, the bendable shaping element 106 has a long, ruler like, rectangular shape that extends in a lateral, horizontal direction across the top upper portion of the elongated cover piece 102. The bendable shaping element 106 is included to allow the neckline 105 including the top edge 110 of the nursing cover 100 and/or elongated cover piece 102 to adjust its shape such that if the bendable shaping element 106 is bent or curved, the neckline 105 and/or top edge 110 of the nursing cover 100 and/or elongated cover piece 102 is also bent or curved.

Advantageously, the bendable shaping element 106 allows the top portion of the elongated cover piece 102, including the neckline 105 of the elongated cover piece 102 to be propped up and away from the chest 450 of the nursing mother 101, which is shown in FIG. 1. Being propped up away from the chest 450 of the nursing mother 101, allows the nursing mother 101 to look down and see or gaze at her nursing child even while the nursing child is covered by the elongated cover piece 102 of the nursing cover 100, which allows the nursing mother 101 not to lose eye contact with her nursing child and to make sure the nursing child is doing well while nursing or while being held under the elongated cover piece 102. Also, the fact that the nursing cover 100 is pushed away from the face of the nursing child and the chest 450 of the mother 101 further ensures better airflow is provided to the nursing child while located under the elongated cover piece 102.

Figure 3B:
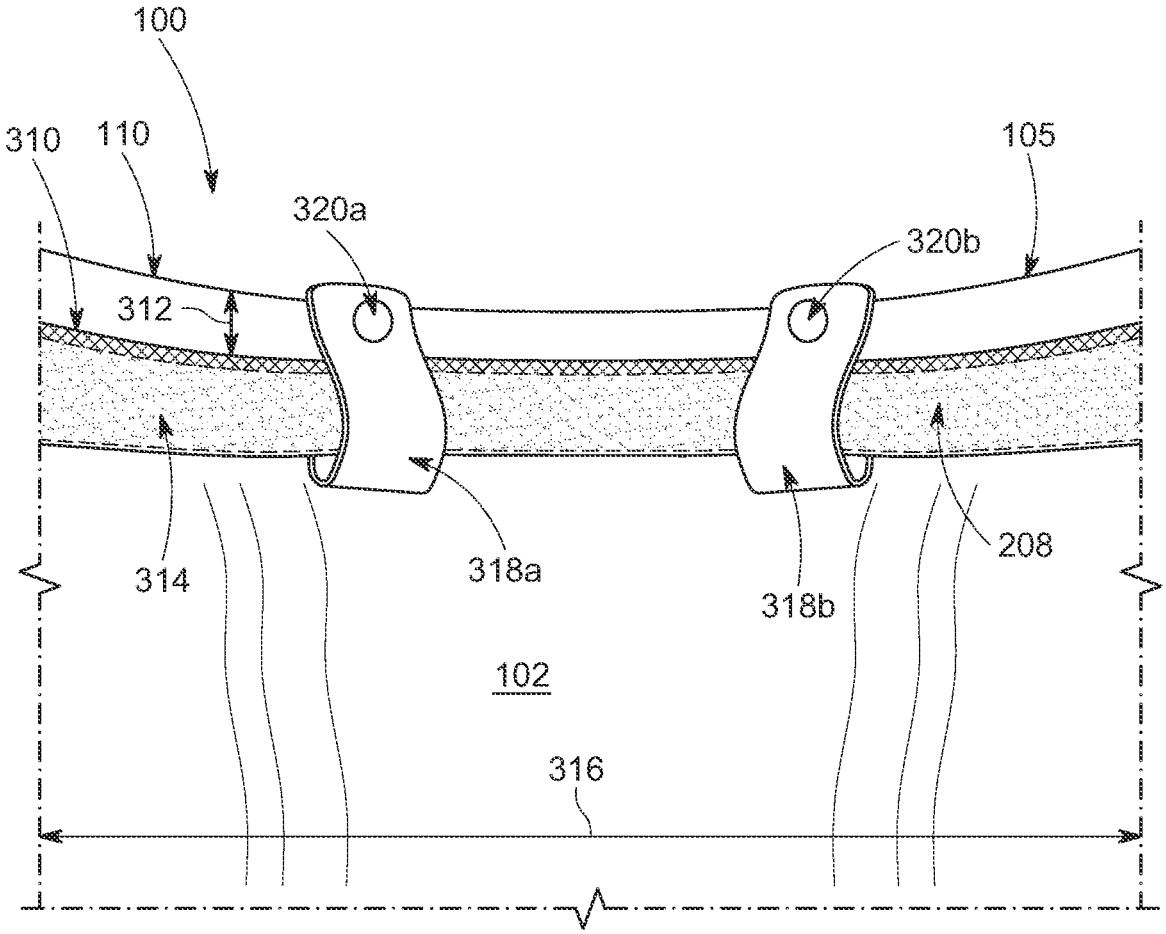
FIG. 3B is a pictorial illustration of the inside surface of a nursing cover including horizontal VELCRO strap to hold a neck fan and fastenable straps.

FIG. 3B shows an interior view of the upper portion of the nursing cover 100 with a focus on the upper portion of the elongated cover piece 102. As shown in this interior view, there may be one or more strips 318*a*, 318*b* of fabric sewn into one end the upper area of the elongated cover piece 102 of the nursing cover 100 that can attach to the elongated cover piece 102 near the top edge 110 of the elongated cover piece 102 with one or more fasteners 320*a*, 320*b*. In a non-limiting embodiment, the one or more fasteners 320*a*, 320*b* may be snaps, but alternative fasteners and mechanisms may be used including, but not limited to, buttons, or zippers.

The strips of fabric 318*a*, 318*b* are configured to help further secure a neck fan 202 when attached to the interior of the elongated cover piece 102 of the nursing cover 100, which is shown in FIG. 4A with the strips of fabric 318*a*, 318*b* secured in place such that the fasteners 320*a*, 320*b* are snapped in place and the strips of fabric 318*a*, 318*b*, encircle the neck fan 202 as shown in FIG. 4A.

In addition to the strips or straps of fabric 318*a*, 318*b*, there may be one or more horizontally oriented pieces of hook and loop fasteners (e.g., VELCRO) 314 that extend laterally across a width 316 of the interior of the upper area of the elongated cover piece 102 of the nursing cover 100. In a non-limiting embodiment, the horizontally oriented piece of hook and loop fasteners 314 that extends laterally across the width 316 of the upper area of the elongated cover piece 102 of the nursing cover 100 is a single integrated piece as shown in FIG. 3B. In a non-limiting embodiment, the horizontal piece of hook and loop fastener 314 may be a single long piece or may be made up of several pieces that piece or connect together to form full continuous coverage using the VELCRO across the width 316 of the interior of the upper area of the elongated cover piece 102 of the nursing cover 100. The one or more horizontally oriented piece or pieces of hook and loop fasteners 314 may be adhesively attached to the upper area of the elongated cover piece 102 of the nursing cover 100 as well as sewn into the upper area of the elongated cover piece 102 of the nursing cover 100 to ensure the one or more horizontally oriented pieces of VELCRO are held in place on the elongated cover piece 102. The one or more horizontally oriented pieces of VELCRO are held in place (e.g., via sewing and/or adhesive) a distance 312 beneath the top edge 110 of the elongated cover piece 102 as shown in FIG. 3B. In some non-limiting embodiments, the VELCRO is positioned beneath the hem 310 (e.g., as shown in FIG. 3B) associated with the sewn in bendable shaping element 106. Accordingly, the horizontally placed VELCRO piece(s) 314 may be positioned over and above the fabric on the interior side of the elongated cover piece 102 that covers the bendable shaping element 106.

As noted above, in one or more non-limiting embodiments, rather than having the horizontally oriented piece of VELCRO 314 shown in FIG. 3B and described above, it is also possible that the cooling neck fan 202 be attached with any type of alternative fasteners to complementary fasteners positioned or otherwise attached to the inside surface of the nursing cover 100 or 602. Accordingly, rather than using VELCRO pieces 314 and 214*a*, 214*b*, there may be one or more complementary pairs of snaps or buttons or pins that function to fasten and attach the cooling neck fan 202 to the inside surface of the nursing cover 100 or 602. Further, in other embodiments, zippers may be used.

FIG. 4A displays the interior view of the nursing cover 100 with the attached neck fan 202. As shown in FIG. 4A, the neck fan 202 lays across a top area of the elongated cover piece 102 of the nursing cover 100. The straps 318*a*, 318*b* are snapped or otherwise fastened shut using fasteners 320*a*, 320*b* to secure around the left side member 206 and right side member 208, respectively of the neck fan 202. The center area 204 of the neck fan 202 may be left exposed as shown in FIG. 4A without an additional strap such as straps 318*a*, 318*b* or additional straps may be added to further secure the center portion 204 of the neck fan 202. In a non-limiting embodiment, FIG. 4F may be used to show what a non-removable neck fan 202 may look like from the reverse view of the nursing cover 100 in a non-limiting embodiment. In other words, the neck fan 202 is fixedly positioned in place as shown in FIG. 4F and not easily removable and thus is displaying an example of a built in embodiment. The neck fan 202 may be sewn in place such that it would be difficult to remove the neck fan 202 due to the thicker grouping of stitching 404*a*, 404*b*, 404*c*, and 404*d* that keep the neck fan 202 in place and facing in the direction shown in FIG. 4F. It is noted that the location of the stitches 404*a*, 404*b*, 404*c*, and 404*d* as shown in FIG. 4F are exemplary only. It is understandable that additional stitches 404 of various thicknesses to robustly hold the neck fan 202 in place may be added to further secure the cooling fan 202 to the nursing covers 100, 602 in a manner that the user is still able to bend the cooling fan 202 towards the baby being nursed or away from the baby being nursed. The presence of the stitching 404 does not alter the ability to manipulate the angle and direction of the cooling fan 202 and how wide or narrow the neckline 105 of the nursing covers 100, 602 may be in one or more non-limiting embodiment. Further, in other non-limiting embodiments, one or more belt loops may be included to hold the nursing fan 202 in place in a more fixed, permanent manner to the inside surface of the nursing cover 100, 602. In another non-limiting embodiment, mesh material may be included and sewn inside the nursing cover 100, 602 and the cooling fan 202 positioned behind the mesh material to allow any cool air provided by the cooling fan 202 to flow onto the baby 604.

Alternatively, in a non-limiting embodiment, the neck fan 202 is removably attached to the horizontally oriented VELCRO piece 314 shown in FIG. 3B. It is noted that the neck fan 202 as held in place by the VELCRO strips 214*a*, 214*b* as well as the straps 318*a*, 318*b* may be oriented so that the air vents 250 face upward towards the user 101 (e.g., as shown in FIG. 4B) or such that the air vents 250 face downwards towards a nursing child (e.g., as shown in FIG. 4E). In this manner, a user 101 may have the neck fan 202 oriented so that the air vents 250 face upward as shown in FIG. 4B, which may be particularly beneficial for the mother/user 101 when the user 101 is pumping her breast milk into containers for the baby to use another time and would like air from the neck fan 202 to be directed to the user's 101 face as well provides privacy and coverage to the user 101 with the nursing cover 102.

When the user 101 wants the nursing child to receive the air from the air vents 250, the neck fan 202 so that the air vents 250 face downwards towards the nursing child's face, whose vantage point is shown in FIG. 4E. As shown in FIG. 4E, the nursing child can still see the user 101's face due to the curved neckline 105 while nursing which provides comfort to the nursing child.

FIG. 4B shows a partial view of the neck fan 202 in the process of being attached to the elongated cover piece 102 of the nursing cover 100. Notably, the hook and loop fastener 214*a* as positioned on the top surface 220 of the left side member 206 is mated or connected to the horizontally oriented hook and loop fastener 314. Similarly, the hook and loop fastener 214*b* as positioned on the top surface 220 of the right side member 208 is matingly connected to the horizontally oriented hook and loop fastener 314. In this manner, the bendable body of the neck fan 202 can be connected via VELCRO attachment according to one or more non-limiting embodiment to the interior surface of the elongated cover piece 102 of the nursing cover 100. The neck fan 202 may be in the manner described above whether the air vents 250 are oriented upwards as shown in FIG. 4B or whether the air vents 250 are oriented downwards as shown in FIG. 4E.

Figure 4C:
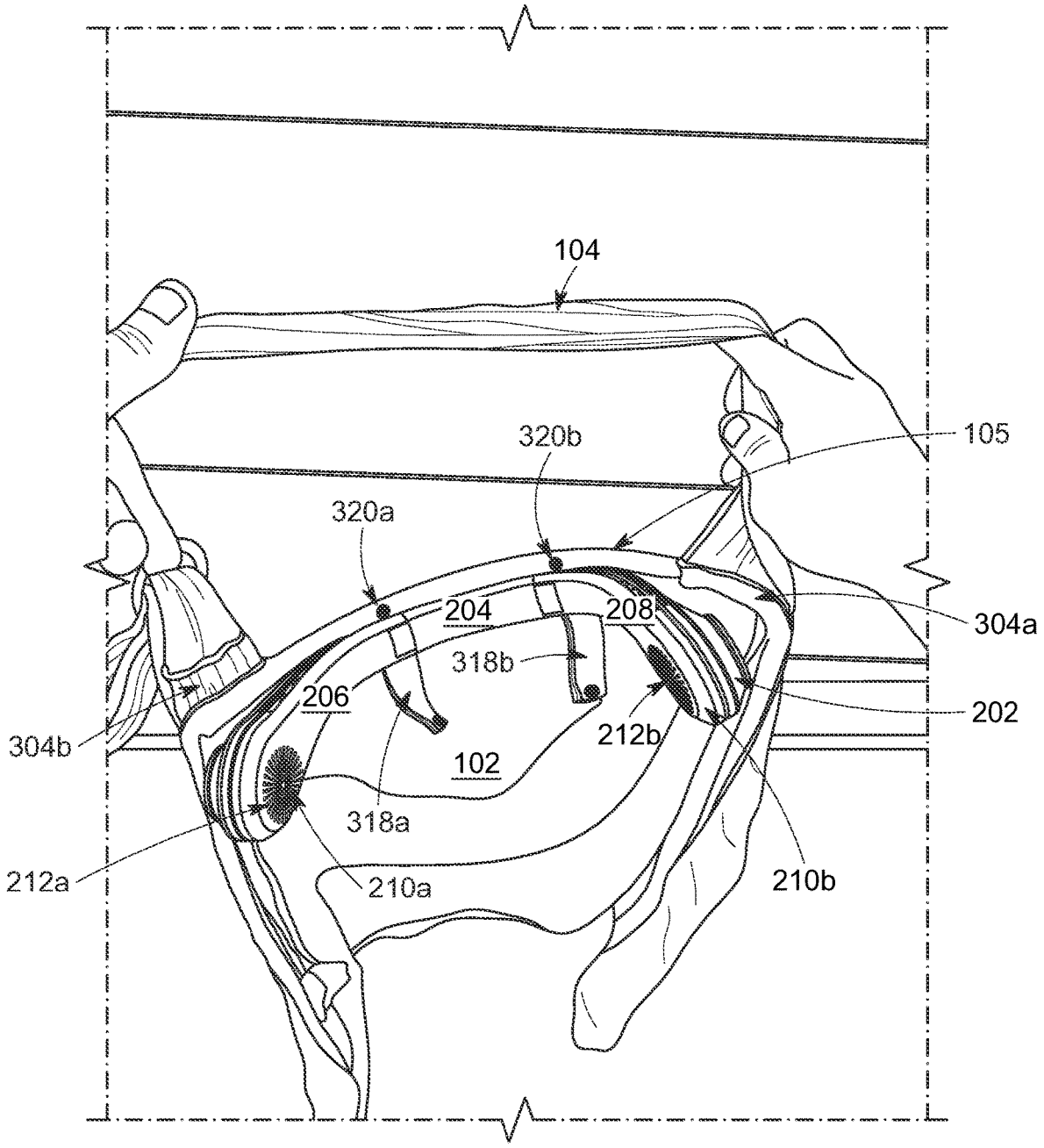
FIG. 4C is a pictorial illustration of the exemplary attachable cooling device attached to the inside surface of the nursing cover with a narrower neckline due to the compressed state of the cooling device.
Figure 4D:
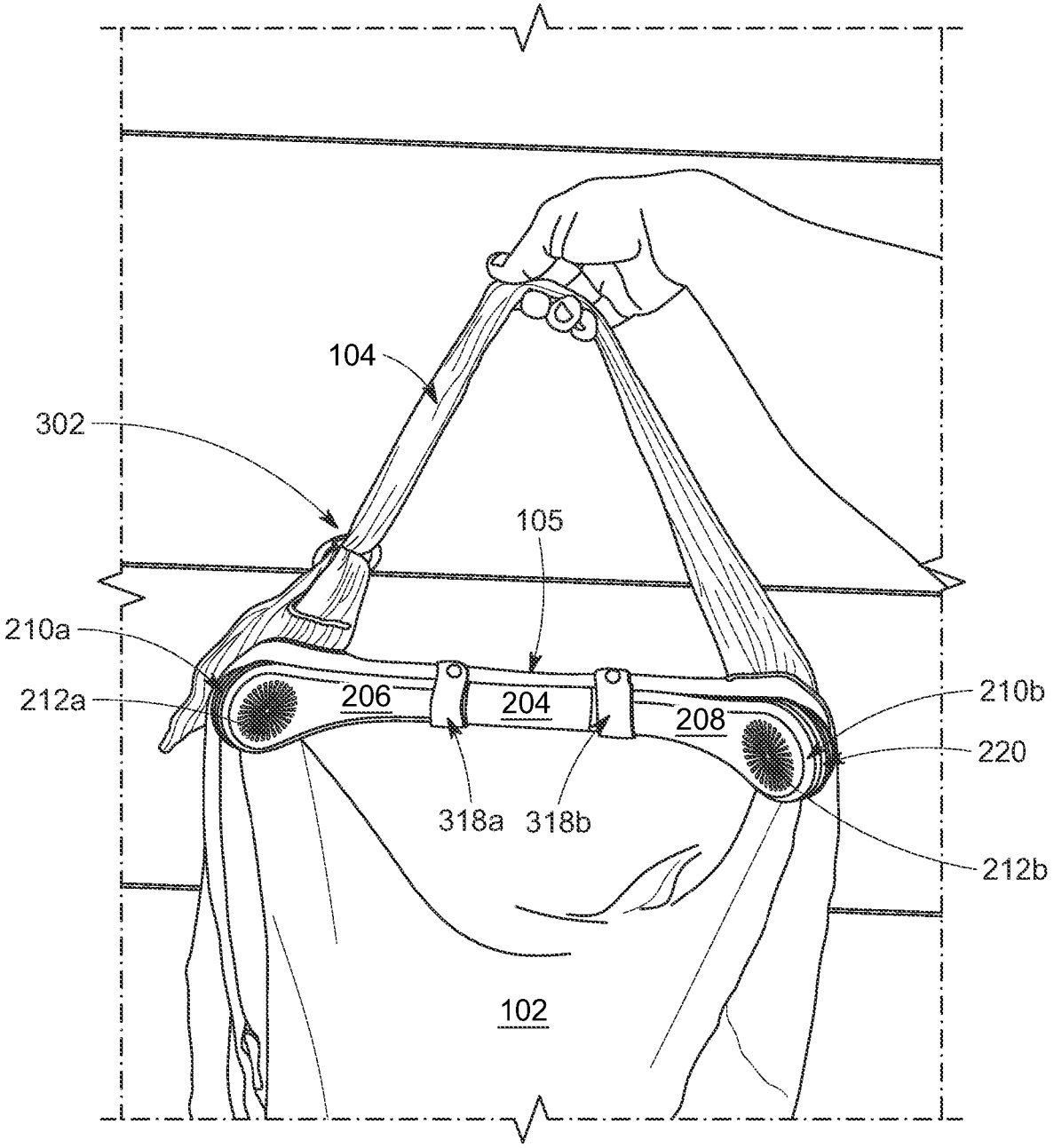
FIG. 4D is a pictorial illustration of the exemplary attachable cooling device attached to the inside surface of the nursing cover with a wider neckline due to the expanded state of the cooling device.
Figure 4E:
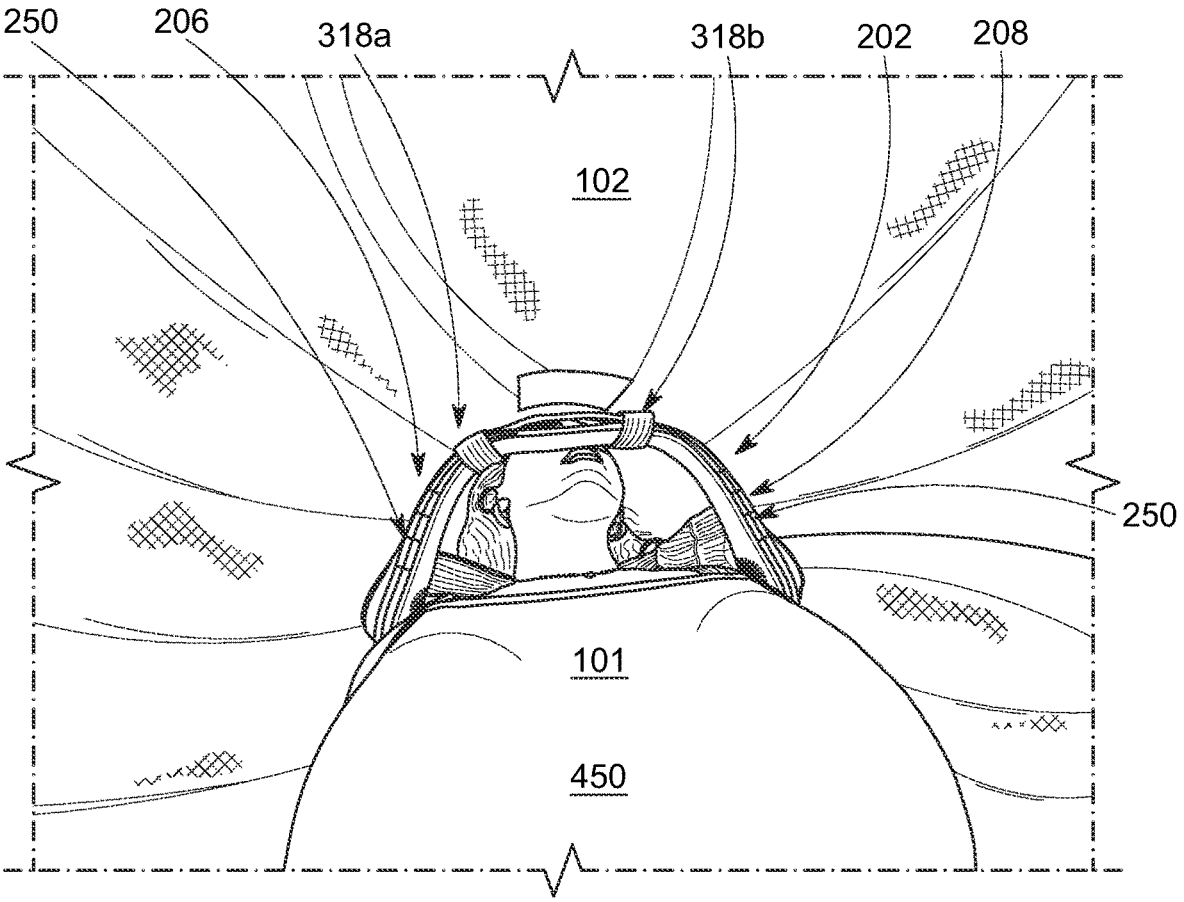
FIG. 4E is a pictorial illustration showing a baby's viewpoint when covered by the nursing cover with the attached cooling device.
Figure 4F:
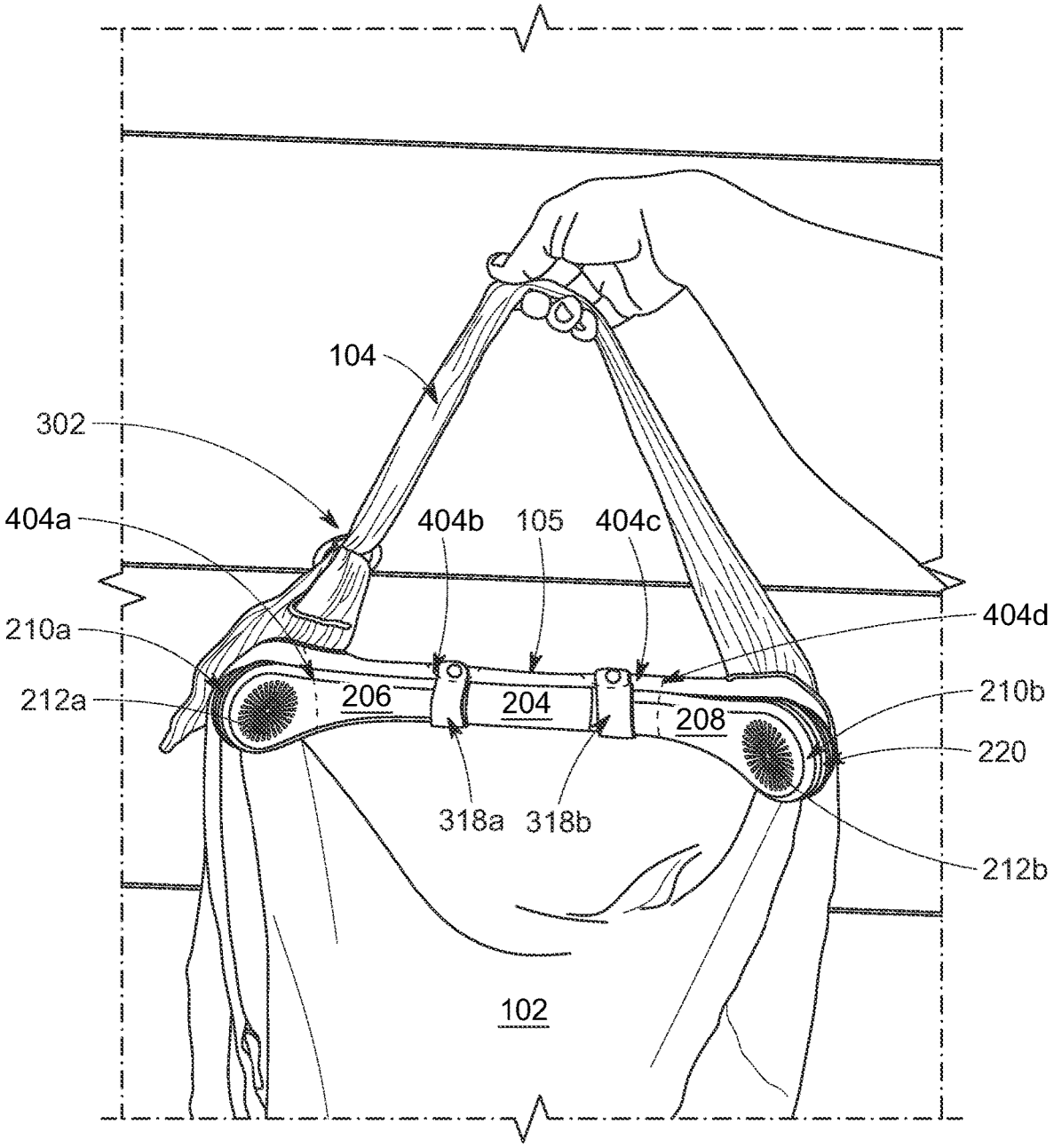
FIG. 4F is a pictorial illustration showing an example of a built in, non-removable cooling device that is attached via sewing to the inside surface of the nursing cover.

FIG. 4C displays that the neck fan 202 may be oriented to a full compressed U-shape, while FIG. 4D displays that the neck fan 202 can be positioned having a wider shape. Accordingly, the neckline 105 of the elongated cover piece 102 may be bowed or compressed as shown in FIG. 1 and FIG. 4C when worn by the nursing mother 101 or may be widened having an expanded shape as shown in FIG. 4D. To adjust the position of the neckline 105 of the elongated cover piece 102 of the nursing cover 100 after having attached the neck fan 202 to the elongated cover piece 102 by mating the VELCRO pieces 214*a*, 214*b* on the neck fan 202 to the VELCRO piece 314 on the nursing cover 100, the user only needs to either push back on the sides 206, 208 and/or first fan inlet 210*a* and second fan inlet 210*b* to widen the neck fan 202 and the neckline 105 of the nursing cover 100 or the user can pull/push forward on the sides 206, 208 and/or first fan inlet 210*a* and second fan inlet 210*b* to narrow or compress the neck fan 202 and the neckline 105 of the nursing cover 100.

When the user 101 is wearing the nursing cover 100 while nursing, the user 101 may prefer that the shape of the nursing cover 100 is more compressed or bowed in shape, such as that shown in FIG. 1 and in FIG. 4C so that the mother's chest area 450 is fully covered and the nursing baby has more airflow coming through the top open gap between the mother's chest 450 and the neckline 105 of the nursing cover 100. Advantageously, the nursing mother 101 can adjust the neckline 105 of the nursing cover 100 easily after attaching the bendable neck fan 202 while the nursing cover 100 is worn by the nursing mother 101. Advantageously, the nursing mother 101 can select how close or far she prefers the air vents 250 are to her nursing baby's face. Further, the user 101 can always adjust the neckline 105 of the nursing cover 100 prior to wearing by holding the nursing cover 100 by the neck strap 104 or other element of the nursing cover 100 and adjusting the shape of the neck fan 202 to in turn adjust the shape of the neckline 105 of the elongated cover piece 102 of the nursing cover 100. The elements of the nursing cover 100 that further assist in bending the shape of the neckline 105 of the nursing cover 100 include the bendable shaping element 106 integrated into the elongated cover piece 102 as well as the bendable body of the neck fan 202. Advantageously, the bendable shaping element 106 offers some rigidity but is also flexible and adjustable.

Figure 5:
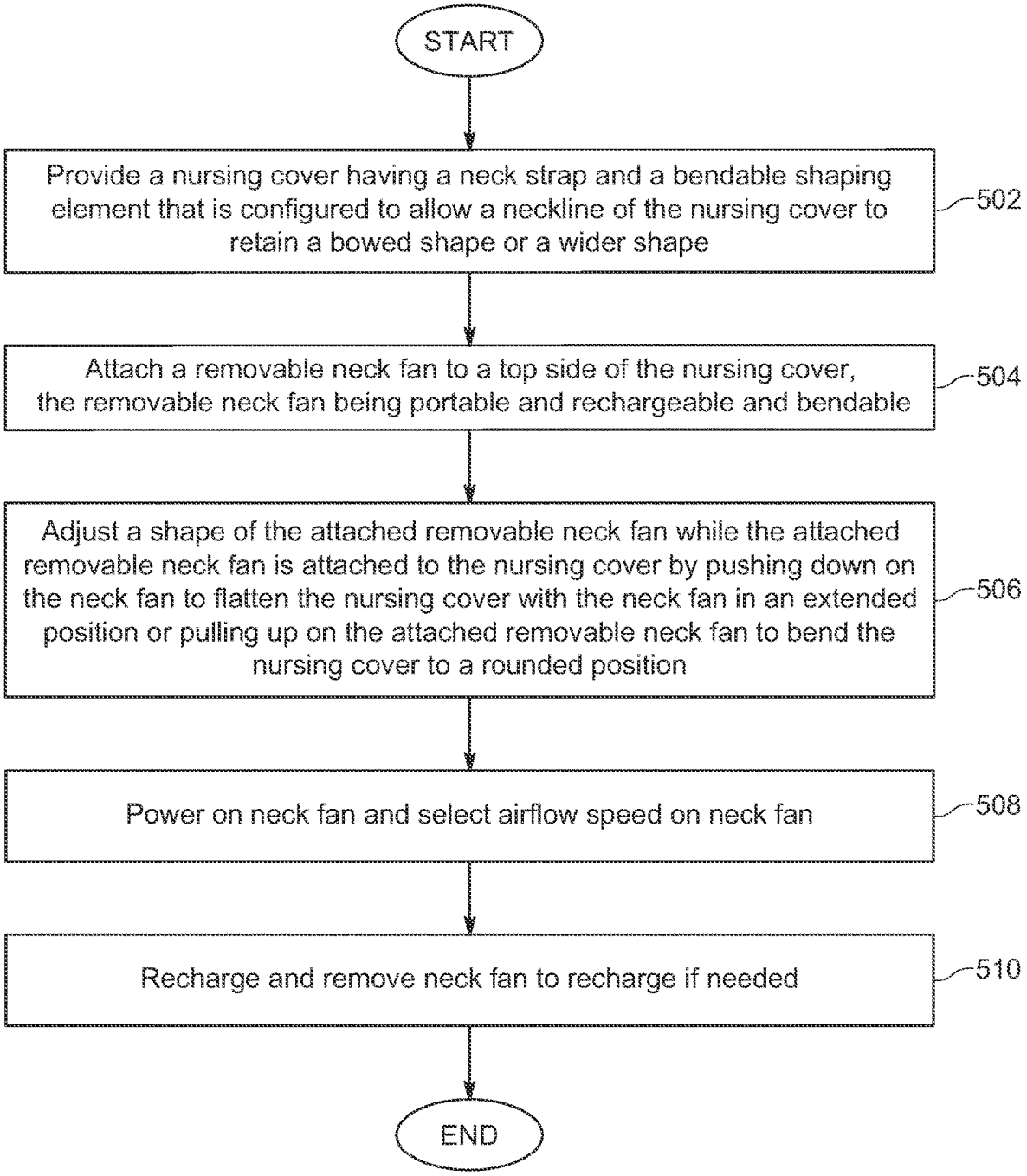
FIG. 5 is a flowchart of a method for using the nursing cover with the integrated cooling device.

FIG. 5 provides a flowchart of an exemplary method for using a nursing cover 100 having a neck fan 202 according to the one or more non-limiting embodiments described above. At step 502, the method may begin with providing a nursing cover 100 having a neck strap 104 and a bendable shaping element 106 that is configured to allow the neckline 105 of the nursing cover 100 to retain a bowed shape as shown in FIG. 1 and in FIG. 4C or alternatively a wider shape, as shown in FIG. 4A and FIG. 4D and in FIG. 4E.

At step 504, the method may further include attach a removable neck fan 202 to an upper portion of the nursing cover 100 as shown in FIGS. 4A-4B. In a non-limiting embodiment, the neck fan 102 may be portable and rechargeable and bendable in one or more non-limiting embodiments (e.g., as shown in FIG. 2A and in FIG. 2B). At step 506, the user 101 (e.g., nursing mother carrying her nursing baby) may adjust a shape of the attachable removable neck fan 202 while the neck fan 202 is still attached to the elongated cover piece 102 of the nursing cover 100 (e.g., via VELCRO pieces 214*a*, 214*b* and 314) by pushing back on the left side member 206, and/or any of the right side member 208, first fan inlet 210*a*, second fan inlet 210*b* of the neck fan 202 to widen the neckline 105 of the nursing cover 100 or by pulling forward on the neck fan 202 to compress or narrow the neckline 105 of the nursing cover 100 to a more rounded position.

At step 508, the user 101 may power on the neck fan 202 and select an airflow speed on the neck fan 202 so that air may blow on the nursing child from the attached neck fan 202. The user 101 has the option to select various airflow speeds from slower to faster using the neck fan 202. At step 510, the neck fan 202 may be removed and/or detached from the nursing cover 100 to be recharged if needed and/or powered off if no longer being used. Advantageously, there are not power cords attached to the neck fan 202 when the neck fan 202 is in use which may bother and/or endanger the mother 101 and the nursing child. Rather, the neck fan 202 may be removed from its position on the nursing cover (e.g., as shown in FIG. 4A and in FIG. 4E) and then separately charged until the enclosed battery is fully charged. To remove the neck fan 202, the user 101 may simply pull on the sides 206, 208 and/or inlets 210*a*, 210*b* of the neck fan 202 to disengage the VELCRO connection of the neck fan 202 to the elongated cover piece 102 of the nursing cover 100.

Notably, the present description includes various embodiments for a nursing cover 100 having an integrated air-emitting neck fan 202. Numerous advantages are provided by the one or more non-limiting embodiments of the nursing cover 100 having an integrated cooling neck fan 202. In one or more non-limiting embodiments, the neck fan 202 may be removably attachable to the interior of the nursing cover 100 (e.g., as shown in FIG. 4B), which allows the nursing mother 101 to wash the nursing cover 100 without the neck fan 100. In other non-limiting embodiments, the neck fan 100 may even be built into and not be removably attachable to the nursing cover 100.

The neck fan 202 as described above is bladeless meaning that there are no rotating blades that can be accessed by a user from the exterior of the neck fan 202 because any "blades" or rotating elements that are used to produce the air of the neck fan 202 are surrounded by the protective plastic or other protective material of the neck fan 202. As mothers want to protect their children from harm and danger, it is a significant improvement that the neck fan 202 may be attached and provide air to the nursing child but does not endanger the child with any visible and/or accessible rotating blades. Further, the mother is not at risk of having any of her hair or clothes or other object becoming entangled with the bladeless neck fan 202.

Figure 6:
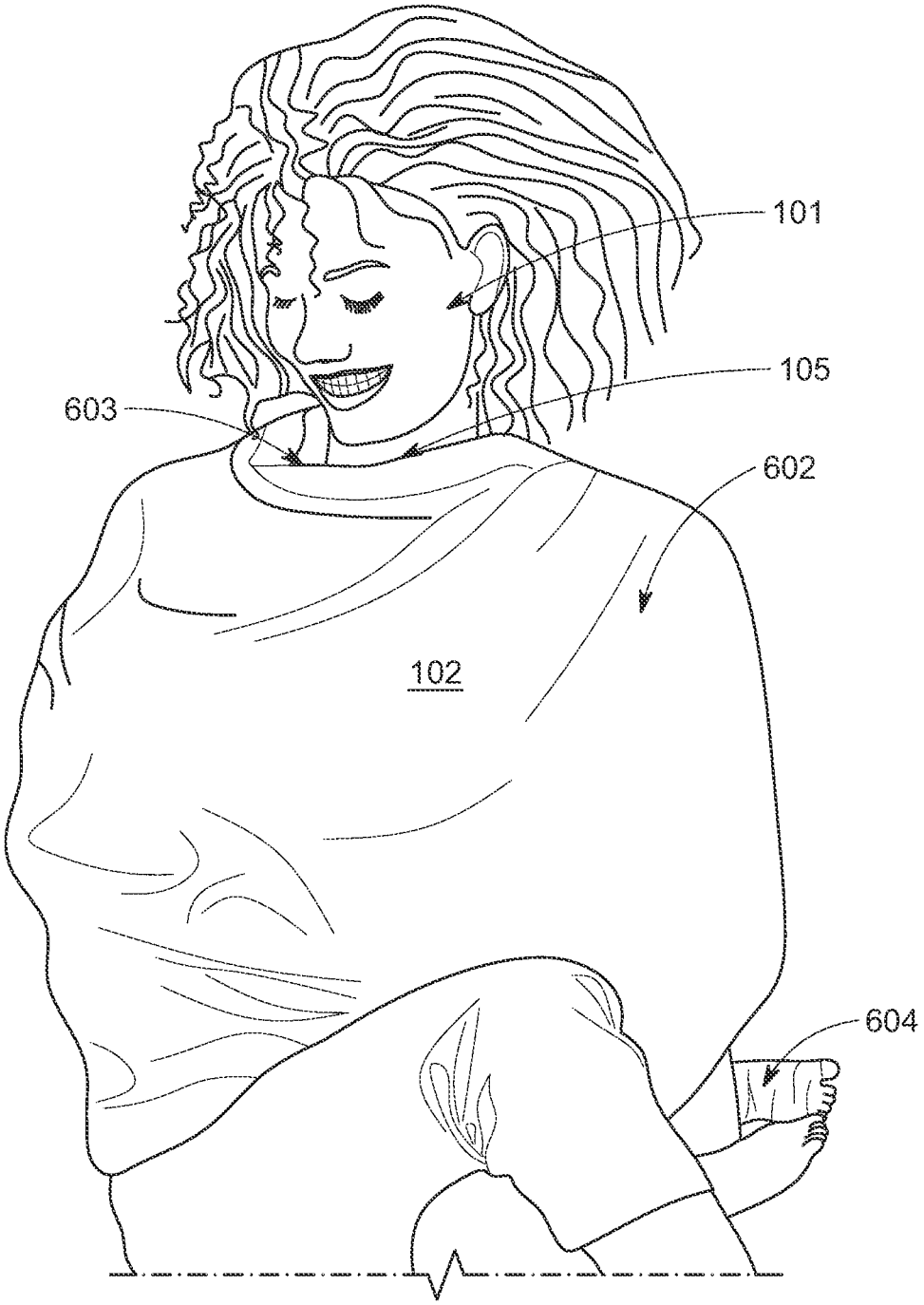
FIG. 6 is a pictorial illustration of another embodiment of a nursing cover suitable for use with an integrated cooling device.
Figure 7:
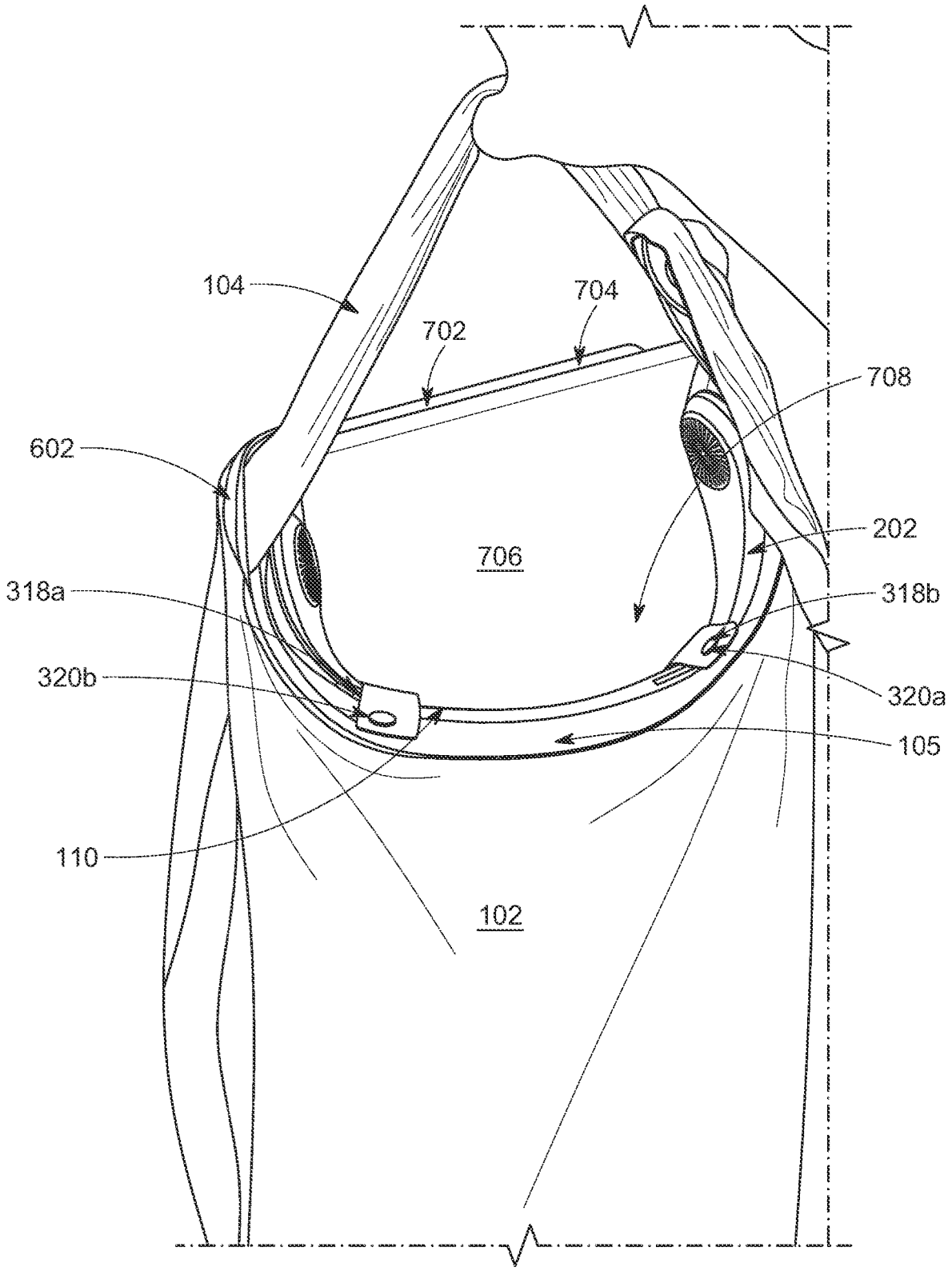
FIG. 7 is a pictorial illustration showing a reverse side of the nursing cover shown in FIG. 6.

FIGS. 6 and 7 provide an additional embodiment for a 360-degree nursing cover 602, in accordance with the functions and features of the nursing cover 100 shown in FIGS. 1-5 and as described above. Notably, the 360 degree nursing cover 602 is a type of nursing cover that fully encircles (e.g., covers over a full 360 degree area) and completely covers the upper body of the nursing mother 101, as shown in FIG. 6, including shoulders, back, arms, and the front of the wearer 101. The 360 degree nursing cover 602 may have an elongated cover piece 102 in accordance with the nursing cover 100 shown in FIG. 1. In a non-limiting embodiment, the 360-degree nursing cover 602 is designed to cover the shoulders, the front chest, the arms, and notably the neck and back of the wearer or nursing mother 101. The nursing cover 602 may in some cases not fully cover the neck or the complete arms of the wearer 101, but would have fabric that extends down over all or a portion of the wearer 101's back and front side. A 360-degree nursing cover 602, as shown in one or more non-limiting examples in FIG. 6 and in FIG. 7, may be a solid cover or made of a variety of prints and colors. In some embodiments, the nursing cover 602 may not include one or more straps as shown in FIG. 6 and in other embodiments, the nursing cover 602 may include one or more straps 104 as shown in FIG. 7. In either instance, the neckline 105 of the nursing cover 602 may include attachment mechanisms to attach a cooling fan 202 to the neckline 105 of the nursing cover 602 and on the interior of the nursing cover 602.

The exemplary nursing cover 102 shown in FIG. 1 may be an example of a partial nursing cover that is not a 360-degree nursing cover as it does not cover the back and shoulders and sides of the wearer 101 in a 360-degree fashion. However, it is noted that the methods of attachment of the cooling fan 202 to the 360-degree nursing cover 602 may be in accordance with as described above as well as other features and functions and exemplary embodiments.

In a non-limiting embodiment, there may be one or more strips 318*a*, 318*b* of fabric sewn into one end on the upper area of the elongated cover piece 602 and/or near the neckline 105 of the nursing cover 602. The one or more strips 318*a*, 318*b* as shown in FIG. 7 may be made and function in accordance with strips 318*a*, 318*b* as shown in FIGS. 3B-4E. Accordingly, one or more fasteners, such as fasteners 320*a*, 320*b* may be used to secure the strips 318*a*, 318*b* in place to the interior upper front side of the 360-degree nursing cover 602. In a non-limiting embodiment, the one or more securing strips 318*a*, 318*b*, may be snaps, but alternative fasteners and mechanisms may be used including, but not limited to, buttons, or zippers. The nursing covers 100, 602 may be made of any type of material either wholly or in combination, whether made of fabric or any other type of material.

The strips of fabric 318*a*, 318*b* are configured to help further secure a neck fan 202 when attached to the interior of the elongated cover piece 102 of the nursing cover 602. In a non-limiting embodiment, the strips of fabric 318*a*, 318*b* are secured in place such that the fasteners 320*a*, 320*b* are snapped in place and the strips of fabric 318*a*, 318*b*, encircle the neck fan 202 as shown in FIG. 7. The strips of fabric 318*a*, 318*b* having one or more fasteners 320*a*, 320*b* may be stitched, sewn, or otherwise attached to the interior of the front side of the 360 degree nursing cover 202 in order for the cooling fan 202 to be removably attached to the interior front side of the 360-degree nursing cover 202. The strips of fabric 318*a*, 318*b* may be one or more horizontally extending hook and loop fastening strips integrated into or attached to an interior surface of the 360-degree nursing cover 602 near the top edge 110 of the elongated cover piece 102.

The 360-degree nursing cover 602 includes a back side 702 having an exterior facing back side 704 and an interior facing front side 706 and a cavity 708 defined by the front side and back side and sides of the 360-degree nursing cover 602. As shown in FIG. 6 and in FIG. 7, the front, back, and side fabric of the 360-degree nursing cover 602 may extend downwards and around a body of the nursing mother 101, in order to fully cover the body of the nursing mother 101 as she nurses the baby 604 (e.g., whose foot is shown in FIG. 6). In a non-limiting embodiment, the user first attaches the cooling fan 202 in place on the interior front side of the nursing cover 602 and then once the cooling fan 202 is removably fixed in place, the wearer 101 pulls the nursing cover 602 over her head. The wearer 101 may then bring the baby 604 underneath the nursing cover 602 such that the front side, sides, and/or back of the 360-degree nursing cover 602 cover the baby 604 while the wearer 101 is nursing. Once the baby 604 is held under the nursing cover 602 and positioned comfortably by the nursing mother 101, the wearer 101 can power on the cooling fan 202 so that the cool air is directed to the baby 604 held by the nursing mother 101 under the nursing cover 602.

If the 360 degree nursing cover 602 does not have one or more straps 104 as shown in FIG. 7, the user 101 may just pull the 360-degree nursing cover 602 over the wearer's 101 head and through the neck hole 603 of the 360-degree nursing cover 602 and then pull the remainder of the body regardless of the material of the 360-degree nursing cover 602 over the wearer 101's head. In some embodiments, the 360-degree nursing cover 602 may have fasteners located anywhere on the back, sides, or front of the 360-degree nursing cover 602 so that the wearer 101 does not only have to pull the 360-degree nursing cover 602 over the head and neck of the wearer 101, but rather, the wearer 101 can unfasten and open the 360 degree nursing cover 602 from one or more sides in order to slip or slide the 360 degree nursing cover 602 over and around the upper half of the wearer 101. In some other embodiments, the neckline 105 of the 360-degree nursing cover 602 may be smaller and narrower or may be larger and wider.

As shown in FIG. 7, in a non-limiting embodiment, there may be one or more straps 104 that the wearer 101 can use to pull the one or more straps over and around the neck of the wearer 101 and then the remainder of the 360-degree nursing cover 602 may wrap all around the upper body of the wearer 101 enough to adequately and thoroughly cover the front side, left and right side, and back side of the wearer 101. There may also be one or more additional fasteners (e.g., zippers, VELCRO, buttons, snaps) to help the wearer 101 fit the 360-degree nursing cover 602 around the body of the wearer 101.

Accordingly, the 360-degree nursing cover 602 offers additional coverage to the sides and back side of the wearer 101 which is a great advantage for the wearer 101 who wants additional coverage while nursing a baby 604 and also while providing the beneficial cooling features of the cooling fan 202.

The 360-degree nursing cover 602 may further comprise an elongated cover piece 102 that further comprises a bendable structural element 106 contained inside and integrated into a top area of the elongated cover piece 102. The bendable structural element 106 is proximate to the top edge 110 of the elongated cover piece 102 and causes a neckline 105 of the elongated cover piece 102 to be adjustable and bendable so that the wearer 101 can adjust the direction and shape of the cooling fan 102 towards either the face of the nursed baby 604 and/or the face of the wearer 101. The cooling neck fan 202 as attached to the 360-degree nursing cover may comprise the same components, functions, and features in accordance with the cooling neck fan 202 shown in FIGS. 2A-5. In accordance with the nursing cover 100 shown in FIGS. 1-5 and described above, the cooling neck fan 202 may be removably or non-removably attached to the 360-degree nursing cover 602. Further, if removably attached, the cooling neck fan 202 may be connected to the interior of the 360-degree nursing cover 602 using the one or more elongated hook and loop fastening strips 314 as shown in FIG. 3B so that the removable cooling neck fan 202 can be attached with corresponding hook and loop fastening strips 214*a*, 214*b* (e.g., as shown in FIG. 2C in a non-limiting embodiment) to the elongated hook and loop fastening strip 314, and connected as shown in FIG. 4A and as described above.

In some cases, the neck fan 202 may be built into the upper area near the neckline 105 of the 360-degree nursing cover 602 in a manner that it is more permanently affixed to the interior of the 360-degree nursing cover 602 (and/or nursing cover 102) such that the cooling fan 202 is not easily removable such as that shown in FIG. 4F in a non-limiting embodiment. In a non-limiting embodiment, the cooling fan 202 may be sewn together with the interior upper area near the top edge 110 and the neck line 105 of the nursing cover 602 in order to have a built-in embodiment as shown in FIG. 4F which combines stitches 404 along with the strips 318*a*, 318*b*, that may also incorporate one or more fasteners 320*a*, 320*b*. Accordingly, when the cooling fan 202 is built into the nursing covers 100, 602, there may still be one or more strips 318*a*, 318*b* that can close around the body of the cooling fan 202.

In another non-limiting embodiment for having a built-in, non-removable cooling fan 202 included with the nursing covers 100 or 602, the cooling fan 202 may be integrated beneath fabric and/or material for the interior facing portion of the nursing covers 100, 602 with cutouts strategically made in the fabric and/or material of the nursing covers 100, 602 that allow cool air from the air vents 250 to be directed outwardly and to the nursing baby (e.g., baby 604 as shown in FIG. 6).

As noted above, babies and infants who nurse do not have the ability to regulate their temperatures well. A nursing mother desires to cover and shield herself from the public eye when in public but may be worried about suffocating or stifling her nursing child with the nursing cover and/or the nursing child overheating when being held against the nursing mother's body while under the nursing cover. The nursing cover 100 shown in FIGS. 1-7 allow the nursing mother 101 to both cover herself and still ensure her baby remains cool even in very hot climates and conditions.

One of ordinary skill in the art may understand that many more benefits and advantages may be provided by nursing cover 100 with integrated cooling neck fan 202 as described in various non-limiting embodiments herein.

In the Summary above and in this Detailed Description, and the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises" and grammatical equivalents thereof are used herein to mean that other components, ingredients, steps, among others, are optionally present. For example, an article "comprising" (or "which comprises") components A, B, and C can consist of (i.e., contain only) components A, B, and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)— (a second number)," this means a range whose lower limit is the first number and whose upper limit is the second number. For example, 25 to 100 mm means a range whose lower limit is 25 mm and upper limit is 100 mm.

Certain terminology and derivations thereof may be used in the following description for convenience in reference only and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention.

The embodiments were chosen and described in order to best explain the principles of the invention and the practical application, and to enable others of ordinary skill in the art to understand the invention for various embodiments with various modifications as are suited to the particular use contemplated. The present invention according to one or more embodiments described in the present description may be practiced with modification and alteration within the spirit and scope of the appended claims. Thus, the description is to be regarded as illustrative instead of restrictive of the present invention.

What is claimed is:

1. A system for nursing a child while cooling the child, comprising:

a nursing cover, comprising:

an elongated cover piece, wherein the elongated cover piece further comprises:

a bendable structural element contained inside and integrated into a top area of the elongated cover piece, wherein the bendable structural element is proximate to a top edge of the elongated cover piece and causes a neckline of the elongated cover piece to be adjustable; and a neck fan, comprising:

a flexible, bendable single body having a curved central top piece that is connected to a left side member and a right side member, wherein the single body is capable of bending to form a general U-shape or being straightened over a range of angles including to approximately 180 degrees; and one or more air vents arranged along the left side member and the right side member of the neck fan configured to release air from the one or more air vents;

wherein the neck fan removably attaches to or is built in and non-removably and fixedly positioned on an inside surface of the nursing cover near the top edge of the elongated cover piece of the nursing cover.

2. The system of claim 1, wherein the nursing cover is a 360 degree nursing cover, wherein the nursing cover comprises material that covers a front side, left side, right side, and back of a wearer.

3. The system of claim 1, wherein the nursing cover is not a 360 degree nursing cover and has an open back and/or side area that leaves a back of a wearer exposed when worn.

4. The system of claim 1, wherein when the neck fan removably attaches to the nursing cover, the nursing cover further comprises one or more hook and loop fastening strips attached to a top surface of the single body of the neck fan, wherein the one or more hook and loop fastening strips attached to the top surface of the single body of the neck fan are adapted to removably fasten to one or more horizontally extending hook and loop fastening strips attached to an interior surface of the nursing cover near the top edge of the elongated cover piece.

5. The system of claim 1, wherein when the neck fan is built in and non-removably integrated with the nursing cover, the neck fan is attached by sewing over areas of the flexible, bendable body of the neck fan to hold the neck fan in place near the top edge of the elongated cover piece of the nursing cover.

6. The system of claim 1, wherein the nursing cover further comprises a neck strap.

7. The system of claim 6, wherein the neck strap is attached to the elongated cover piece at a top edge of the elongated cover piece.

8. The system of claim 1, further comprising, a first strip and a second strip attached to the interior surface of the nursing cover beneath the one or more horizontally extending hook and loop fastening strips.

9. The system of claim 8, wherein the first strip and the second strip each include a snap fastener.

10. The system of claim 1, wherein the neck fan is bladeless and has no visible fan blade.

11. The system of claim 1, wherein the neck fan is rechargeable.

12. The system of claim 1, wherein the neck fan is portable.

13. The system of claim 1, wherein the neck strap and the elongated cover piece are made of fabric.

14. The system of claim 13, wherein the fabric comprises muslin.

15. The system of claim 1, wherein the bendable structural element is a bendable metal wire.

16. The system of claim 1, wherein the bendable structural element is a plastic element.

17. The system of claim 1, wherein the bendable structural element comprises a combination of metal and plastic material formed into the bendable structural element.

18. The system of claim 1, wherein ambient air flows through one or more intake holes positioned on a first fan inlet and a second fan inlet and then out through the one or more air vents.

19. The system of claim 1, wherein the neck fan attaches to the nursing cover using one or more fasteners.

* * * * *